US008814681B2

(12) United States Patent
Wells et al.

(10) Patent No.: US 8,814,681 B2
(45) Date of Patent: Aug. 26, 2014

(54) CANDLE DEVICE FOR GENERATING DISPLAY INTERFACES ON THE MAIN DISPLAY OF A GAMING MACHINE

(75) Inventors: William R. Wells, Carson City, NV (US); Ali Saffari, Reno, NV (US); Christopher Lundy, Reno, NV (US); Craig Paulsen, Reno, NV (US)

(73) Assignee: Leap Forward Gaming, Inc., Reno, NV (US)

( * ) Notice: Subject to any disclaimer, the term of this patent is extended or adjusted under 35 U.S.C. 154(b) by 0 days.

(21) Appl. No.: 13/327,584

(22) Filed: Dec. 15, 2011

(65) Prior Publication Data

US 2012/0108338 A1 May 3, 2012

Related U.S. Application Data

(63) Continuation-in-part of application No. 12/943,789, filed on Nov. 10, 210, now Pat. No. 8,088,014.

(60) Provisional application No. 61/303,106, filed on Feb. 10, 2010.

(51) Int. Cl.

| | |
|---|---|
| ***A63F 9/24*** | (2006.01) |
| ***G07F 17/32*** | (2006.01) |
| ***G07F 9/02*** | (2006.01) |

(52) U.S. Cl.

CPC ..... *G07F 9/026* (2013.01); *G07F 17/3223* (2013.01); *G07F 17/323* (2013.01); *G07F 17/3202* (2013.01); *G07F 17/32* (2013.01); *G07F 17/3241* (2013.01)

USPC ..... 463/31; 463/25; 463/42

(58) Field of Classification Search

USPC ..... 463/25, 31, 42

See application file for complete search history.

(56) References Cited

U.S. PATENT DOCUMENTS 5,091,713 A 2/1992 Horne et al.
5,259,613 A 11/1993 Marnell (Continued)

FOREIGN PATENT DOCUMENTS

EP 0 744 786 11/1996
EP 1 074 955 2/2001

(Continued)

OTHER PUBLICATIONS

International Search Report dated Jun. 22, 2011 from International Application No. PCT/US2010/059551.

(Continued)

*Primary Examiner* — Dmitry Suhol
*Assistant Examiner* — Carl V Larsen
(74) *Attorney, Agent, or Firm* — Kwan & Olynick LLP

(57) ABSTRACT

A candle device for a gaming machine including a secondary processor is described. The candle device can include a number of stages that when activated convey information about the status of the gaming machine. The secondary processor, disposed within a secure enclosure in the candle device, can be configured to control peripheral devices disposed with a main cabinet of the gaming machine that receive control commands from a game controller. In particular, the secondary processor can be configured to determine a size and a position of windows on the main touch screen display where a first window is for outputting video content from the game controller and a second window is for outputting video content from the secondary processor. The secondary processor can use the second window to add new features to the gaming machine, such as a verification interface for transactions involving mobile devices.

21 Claims, 12 Drawing Sheets

(56) References Cited

U.S. PATENT DOCUMENTS 5,342,047 A 8/1994 Heidel et al.
5,412,404 A 5/1995 Candy
5,450,938 A 9/1995 Rademacher
5,531,309 A 7/1996 Kloss et al.
5,605,506 A 2/1997 Hoorn et al.
5,611,730 A 3/1997 Weiss
5,655,961 A 8/1997 Acres et al.
5,769,269 A 6/1998 Peters
5,844,808 A 12/1998 Konsmo et al.
5,908,354 A 6/1999 Okuniewicz
6,146,276 A 11/2000 Okuniewicz
6,249,885 B1 6/2001 Johnson et al.
6,286,756 B1 9/2001 Stinson et al.
6,354,749 B1 3/2002 Pfaffenberger, II
6,379,246 B1 4/2002 Dabrowski
6,533,659 B2 3/2003 Seymour et al.
6,548,967 B1 4/2003 Dowling et al.
6,638,170 B1 10/2003 Crumby
6,846,238 B2 1/2005 Wells
6,854,645 B1 2/2005 Somers, Jr. et al.
6,897,624 B2 5/2005 Lys et al.
6,924,903 B2 8/2005 Brooks et al.
6,997,803 B2 2/2006 LeMay et al.
7,014,563 B2 3/2006 Stephan et al.
7,051,221 B2 5/2006 Clabes et al.
7,099,035 B2 8/2006 Brooks et al.
D529,966 S 10/2006 LeSourd et al.
D536,389 S 2/2007 LeSourd et al.
D536,742 S 2/2007 Kaminkow et al.
7,178,941 B2 2/2007 Roberge et al.
7,202,613 B2 4/2007 Morgan et al.
7,213,812 B2 5/2007 Schubert et al.
7,270,605 B2 9/2007 Russell et al.
7,290,072 B2 10/2007 Quraishi et al.
7,309,965 B2 12/2007 Dowling et al.
7,311,598 B2 12/2007 Kaminkow et al.
7,311,604 B2 12/2007 Kaminkow et al.
7,385,359 B2 6/2008 Dowling et al.
7,390,257 B2 6/2008 Paulsen et al.
7,442,125 B2 10/2008 Paulsen et al.
7,529,868 B2 5/2009 Brooks et al.
7,550,931 B2 6/2009 Lys et al.
7,641,554 B2 1/2010 Paulsen et al.
7,642,730 B2 1/2010 Dowling et al.
7,646,029 B2 1/2010 Mueller et al.
7,689,167 B2 3/2010 Sengupta et al.
7,704,147 B2 4/2010 Quraishi et al.
7,764,026 B2 7/2010 Dowling et al.
7,803,053 B2 9/2010 Atkinson
8,075,408 B2 12/2011 Hwang
8,083,592 B2 12/2011 Wells
8,088,014 B2 1/2012 Wells
8,241,123 B2 8/2012 Kelly et al.
8,241,124 B2 8/2012 Kelly et al.
8,371,937 B2 2/2013 Wells
8,696,449 B2 4/2014 Wells
2001/0036866 A1 11/2001 Stockdale et al.
2002/0016829 A1 2/2002 Defosse
2002/0115487 A1 8/2002 Wells
2002/0128932 A1 9/2002 Yung et al.
2002/0132663 A1 9/2002 Cumbers
2003/0054880 A1 3/2003 Lam et al.
2003/0074106 A1 4/2003 Butler
2003/0081824 A1 5/2003 Mennie et al.
2003/0109302 A1 6/2003 Rist
2003/0109307 A1* 6/2003 Boyd ..... 463/41
2003/0190958 A1 10/2003 Paulsen
2003/0195037 A1 10/2003 Vuong et al.
2004/0014526 A1 1/2004 Kulas
2004/0043814 A1 3/2004 Angell et al.
2004/0082385 A1 4/2004 Silva et al.
2004/0132532 A1 7/2004 Brosnan et al.
2004/0146975 A1 7/2004 Yaver et al.
2004/0153748 A1 8/2004 Fabrizi et al.
2004/0166917 A1 8/2004 Lam et al.
2004/0166932 A1 8/2004 Lam et al.
2004/0171423 A1 9/2004 Silva et al.
2004/0238319 A1 12/2004 Hand et al.
2004/0254006 A1 12/2004 Lam et al.
2004/0254013 A1 12/2004 Quraishi et al.
2005/0003890 A1 1/2005 Hedrick et al.
2005/0041161 A1 2/2005 Dowling et al.
2005/0043086 A1 2/2005 Schneider
2005/0061605 A1 3/2005 Bell et al.
2005/0099824 A1 5/2005 Dowling et al.
2005/0153776 A1 7/2005 LeMay et al.
2005/0159203 A1 7/2005 Bond et al.
2005/0216120 A1 9/2005 Rosenberg et al.
2005/0248299 A1 11/2005 Chemel et al.
2005/0261057 A1 11/2005 Bleich et al.
2005/0275626 A1 12/2005 Mueller et al.
2005/0277471 A1 12/2005 Russell et al.
2005/0282631 A1 12/2005 Bonney et al.
2006/0035707 A1 2/2006 Nguyen et al.
2006/0046819 A1 3/2006 Nguyen et al.
2006/0046849 A1 3/2006 Kovacs
2006/0063594 A1 3/2006 Benbrahim
2006/0073869 A1 4/2006 LeMay et al.
2006/0166741 A1 7/2006 Boyd et al.
2006/0178190 A9 8/2006 Okuniewicz
2006/0189391 A1 8/2006 Bird
2006/0217172 A1 9/2006 Roireau
2006/0219777 A1 10/2006 Arora et al.
2006/0221386 A1 10/2006 Brooks et al.
2006/0287095 A1* 12/2006 Mattice et al. ..... 463/42
2007/0010318 A1 1/2007 Rigsby et al.
2007/0021215 A1 1/2007 Russell et al.
2007/0050443 A1 3/2007 Ewing et al.
2007/0111796 A1 5/2007 Giaimo, III et al.
2007/0119681 A1 5/2007 Blake et al.
2007/0123335 A1 5/2007 Okada
2007/0189026 A1 8/2007 Chemel et al.
2007/0243925 A1 10/2007 LeMay et al.
2007/0243934 A1 10/2007 Little et al.
2008/0020838 A1 1/2008 Slattery
2008/0039972 A1 2/2008 Walker et al.
2008/0045345 A1 2/2008 Bird
2008/0076506 A1 3/2008 Nguyen et al.
2008/0113767 A1 5/2008 Nguyen et al.
2008/0194329 A1 8/2008 Page et al.
2008/0215391 A1 9/2008 Dowling et al.
2008/0242408 A1 10/2008 Hwang
2008/0274795 A1 11/2008 Carpenter et al.
2008/0293494 A1 11/2008 Adiraju et al.
2008/0300046 A1 12/2008 Gagner et al.
2008/0313636 A1 12/2008 Goldstein et al.
2009/0029770 A1 1/2009 Nagano
2009/0058884 A1* 3/2009 Li et al. ..... 345/660
2009/0069094 A1 3/2009 Brosnan et al.
2009/0082079 A1 3/2009 Kuhn et al.
2009/0094081 A1 4/2009 Wittern et al.
2009/0098943 A1 4/2009 Weber et al.
2009/0104960 A1 4/2009 Kelly et al.
2009/0124329 A1* 5/2009 Palmisano ..... 463/20
2009/0137318 A1 5/2009 Russo et al.
2009/0138638 A1 5/2009 Russo et al.
2009/0149253 A1* 6/2009 Kelly et al. ..... 463/36
2009/0172980 A1 7/2009 Heather et al.
2009/0174346 A1 7/2009 Hwang et al.
2009/0197673 A1 8/2009 Bone et al.
2009/0233705 A1 9/2009 LeMay et al.
2009/0247281 A1 10/2009 Voutes
2009/0270159 A1 10/2009 Kato et al.
2009/0270167 A1 10/2009 Ajiro et al.
2009/0276640 A1 11/2009 Wu
2009/0294243 A1 12/2009 Charych et al.
2009/0307505 A1 12/2009 Robertson et al.
2009/0325686 A1 12/2009 Davis et al.
2010/0016073 A1 1/2010 Goldstein et al.
2010/0020546 A1 1/2010 Kukita
2010/0075753 A1* 3/2010 Atkinson ..... 463/31
2010/0105454 A1 4/2010 Weber et al.
2010/0120518 A1 5/2010 Borissov et al.
2010/0124990 A1 5/2010 Crowder

(56) References Cited

U.S. PATENT DOCUMENTS

| | | | |
|---|---|---|---|
| 2010/0127634 | A1 | 5/2010 | Dowling et al. |
| 2010/0130278 | A1 | 5/2010 | Shimabukuro et al. |
| 2010/0197404 | A1 | 8/2010 | Lum et al. |
| 2010/0203961 | A1 | 8/2010 | Burke et al. |
| 2010/0255902 | A1 | 10/2010 | Goldstein et al. |
| 2010/0285866 | A1 | 11/2010 | Bleich et al. |
| 2012/0122584 | A1 | 5/2012 | Nguyen |
| 2012/0142403 | A1 | 6/2012 | Prather et al. |
| 2012/0142412 | A1 | 6/2012 | Carson, Jr. et al. |
| 2013/0130790 | A1 | 5/2013 | Wells |
| 2014/0087849 | A1 | 3/2014 | Page et al. |

FOREIGN PATENT DOCUMENTS

| | | |
|---|---|---|
| EP | 2 009 602 | 12/2008 |
| JP | 56168275 | 12/1981 |
| WO | WO 97/27576 | 7/1997 |
| WO | WO 2007/146316 | 12/2007 |

OTHER PUBLICATIONS

Written Opinion dated Jun. 22, 2011 from International Application No. PCT/US2010/059551.

"U.S. Appl. No. 13/738,774, Notice of Allowance mailed Jan. 14, 2014", 8 pgs.

* cited by examiner

CANDLE DEVICE FOR GENERATING DISPLAY INTERFACES ON THE MAIN DISPLAY OF A GAMING MACHINE

CROSS REFERENCE TO RELATED APPLICATIONS

This application claims priority under 35 U.S.C. §120 and is a continuation-in-part of U.S. patent application Ser. No. 12/943,789, titled, "Gaming Device and Method for Wireless Gaming System Providing Non-Intrusive Processes," by Wells, filed Nov. 10, 2010, which issued as U.S. Pat. No. 8,088,014 on Jan. 3, 2012; which claims priority under 35 U.S.C. §119(e) to U.S. Provisional Patent Application Ser. No. 61/303,106 entitled "Gaming Device and Method for Wireless Gaming System Providing Non-Intrusive Processes" by Wells, filed Feb. 10, 2010 each of which are incorporated by reference in their entirety and for all purposes.

BACKGROUND

1. Field of the Invention

The invention relates to gaming devices that provide communication capabilities and enhanced gaming functions on a gaming machine.

2. Description of the Related Art

Casinos derive a large portion of their revenues from electronic gaming machines including mechanical and video slot machines. The operating costs associated with maintaining electronic gaming machines is an important factor to casino operators. To maximize their profitability, casino operators wish to minimize the electronic gaming machine operating costs.

A significant component of the operating costs is related to the performance of maintenance operations requiring access to the interior of a gaming machine. For instance, access to the interior of the gaming machine is needed to periodically remove cash from the gaming machine, such as coins in a drop box or bills stored in a bill stacker. As another example, access to the interior of the gaming machine is needed to periodically replenish paper used to print ticket vouchers for cashless gaming applications.

For security and regulatory purposes, electronic gaming machines include a number of locked enclosures that are monitored by an internal security system. The locked enclosures and security system help to prevent unauthorized access to resources within the electronic gaming machine that may be targets of theft or tampering, such as deposited money or gaming software. To address a maintenance issue that requires access to interior portions of the gaming machine, often two or more keys carried by separate individuals can be required. During the performance of the maintenance operation in the interior, one individual not performing the maintenance may be required to watch the other individual performing the maintenance operation. Thus, a significant contributor to the gaming machine operating costs is labor costs associated with maintenance.

Besides labor costs, while the gaming machine is being maintained it is not available for game play. Thus, revenue is lost which also contributes to the operating costs. Further, some maintenance operations, such as replenishing blank tickets that can be used to print redeemable ticket vouchers involve material costs. Thus, some maintenance operations contribute both material costs and labor costs to the gaming machine operating costs.

Balanced against minimizing operating costs are providing functions that make the machines more convenient for a player to use and encourage repeated use of the machines. For instance, a bill validator on a gaming machine is not required and its use increases gaming machine operating costs. However, the availability of a bill validator makes a gaming machine more convenient for a player to use which outweighs the additional operating costs associated with the bill validator. As other example, loyalty programs and associated hardware that allow for player rewards and a personalization of a gaming session increases operating costs. Nevertheless, it has been found that these features make a game play session more satisfying to players such that the average amount of game play or the amount of repeat business from a typical player is increased. The increase in game play or repeat business outweighs the operating costs associated with providing these features.

Thus, in view of the above, apparatus and method are desired that either reduce gaming machine operating costs or provide new features with benefits to players that outweigh the additional operation costs associated with providing the new features.

SUMMARY

Broadly speaking, the embodiments disclosed herein describe relate to providing enhanced gaming functionality to wagered-based gaming devices, such as but not limited to mechanical slot reel or video slot machines. In particular, the embodiments can be used on gaming devices that execute regulated gaming software to control a play of a wager-based game on the gaming device. A game controller on the gaming device can execute the regulated gaming software. In one embodiment, the enhanced gaming functionality can be generated using a secondary processor disposed within an interior portion of a candle device. The candle device can be mounted to an exterior surface, such as the top portion, of a gaming machine cabinet.

The candle device can include a number of lighting stages that when activated alone or in combination with other stages convey information about the status of the gaming machine. The candle device can include a secure enclosure for securing a secondary processor is disposed within the secure enclosure. The secondary processor can be configured to communicate with peripheral devices disposed within a main cabinet of the gaming machine which are also coupled to a game controller disposed within the main cabinet. The secondary processor can control the peripheral devices to add enhanced functionality to the gaming machine without requiring alteration of the regulated software executed by the game controller.

In particular embodiments, the secondary processor can be configured to control a main touch screen display on the gaming machine used to display a wager-based game. The control can include determining a size and position of a window for outputting content from the game controller and a size and position of a window for outputting content from the secondary processor. In one embodiment, the secondary processor can be configured to control the main display to generate a verification interface that allows verification information associated with an electronic transaction involving a portable electronic device to be entered at the gaming machine.

A wager-based gaming machine can include a dual port touch screen (DPTS) display communicatively coupled to a) a game controller disposed within the gaming machine cabinet and b) a candle controller in a candle device externally mounted to the cabinet. One aspect of the described embodiments is related to a method in a candle device including a candle controller and a plurality of lighting stages with internal lighting elements where the lighting stages are lit alone or in combination with other stages to convey information associated with a status of a gaming machine. The method can be generally characterized as including 1) determining a resolution of video content for a wager-based game output to a dual port touch screen (DPTS) display by a game controller on the gaming machine where a first port is coupled via a first communication pathway to the game controller for receiving the video content for the wager-based game and the second port is coupled via a second communication pathway to a candle controller for receiving video content generated from the candle controller; 2) determining a display interface controlled by the candle device is triggered; 3) based upon the determined resolution of the video content for the wager-based game and a resolution for the of the DPTS display, determining a display mode for the DPTS display wherein the display mode includes a size and a position of a display window for outputting the video content for the wager-based game on the DPTS display and a size and a position of a display window for outputting the video content from the candle controller associated with the display interface; 4) sending commands to the DPTS display for generating the display mode; 5) generating the video content associated with the display interface; 6) sending the video content to the DPTS display; 7) receiving touch screen data from the DPTS display; and 8) in response to receiving the touch screen data, generating and sending new video content associated with the display interface to the DPTS display.

Another aspect of the described embodiments is related to a retrofit system for a wager-based gaming machine including a gaming machine cabinet. The retrofit system can be generally characterized as including 1) a touchscreen display for replacing an existing main display on the gaming machine and 2) a candle device for replacing an existing candle device on the gaming machine. The touch screen display can include a) a touchscreen sensor, b) a first video interface for receiving video content for a wager-based game from a game controller, c) a second video interface for receiving video content associated with a display interface from a candle controller; and d) a touch screen display controller for i) receiving control commands from the candle controller wherein the control commands specify a display mode including a size and a position of a first portion of the touch screen display for displaying the video content from the game controller and a size and a position of a second portion of the touch screen display for displaying the video content from the candle controller; ii) sending the touch screen input data to the game controller and iii) sending touch screen input data to the candle controller.

The candle device can include 1) a plurality of lighting stages each with internal lighting elements wherein the lighting stages are lit alone or in combination with other stages to convey information associated with a status of the wager-based gaming machine; 2) a housing including a light transmissive portion that allows light emitted from the internal lighting elements to pass through the housing; 3) a mounting interface coupled to the housing for mounting the candle device to an exterior surface of the gaming machine cabinet; 4) a candle controller, including a processor and a memory, secured within the housing, configured to i) generate and send the video content associated with the display interface via the second video interface and ii) send and generate the control commands for specifying the display mode to the touch screen display controller; iii) determine the video content associated with the display interface, and 4) a wiring harness for enabling a first communication pathway between the candle controller and the game controller, a second communication pathway between the candle controller and the second video interface and a third communication pathway between the candle controller and the touchscreen display controller.

Yet another aspect of the described embodiments is related to a gaming machine. The gaming machine can include 1) a gaming machine cabinet, a game controller, a touch screen display, and a candle device. The game controller can be disposed within an interior portion of the gaming machine cabinet. Further, the game controller can be configured to control a wagered based game including generating video game content for the wager-based game at a fixed resolution. In addition, the game controller can be configured to send the video game content to a touchscreen display and receive touch screen input data from the touchscreen display.

The touchscreen display can include a) a touchscreen sensor; b) a first video interface for receiving the game content from the game controller; c) a second video interface for receiving content from a candle controller and d) a controller. The controller can be configured for 1) receiving control commands from the candle controller where the control commands specify a display mode including a size and a position of a first portion of the touch screen display for displaying the video game content from the game controller and a size and a position of a second portion of the touch screen display for displaying the candle video content; 2) sending the touch screen input data only associated with the first portion to the game controller and 3) sending touch screen input data associated with the first and the second portion to the candle controller.

The candle device can include a plurality of lighting stages with internal lighting elements where the lighting stages are lit alone or in combination with other stages to convey information associated with a status of the gaming machine. In addition, the candle device can include 1) a housing including a transmissive portion that allows light emitted from the internal lighting elements to pass through the housing; 2) a mounting interface attached to the housing for coupling the candle device to an exterior surface of the gaming machine cabinet; and 3) a candle controller, including a processor and a memory, secured within the housing. The candle controller can be configured to i) generate and send the video content to the touch screen display, ii) send and generate the control commands for specifying the display mode and iii) receive the touch screen input data associated with the first and second portion.

Other aspects and advantages will become apparent from the following detailed description taken in conjunction with the accompanying drawings which illustrate, by way of example, the principles of the invention.

BRIEF DESCRIPTION OF THE DRAWINGS

The described embodiments will be readily understood by the following detailed description in conjunction with the accompanying drawings, wherein like reference numerals designate like structural elements, and in which.

DETAILED DESCRIPTION OF THE DESCRIBED EMBODIMENTS

Figure 1:
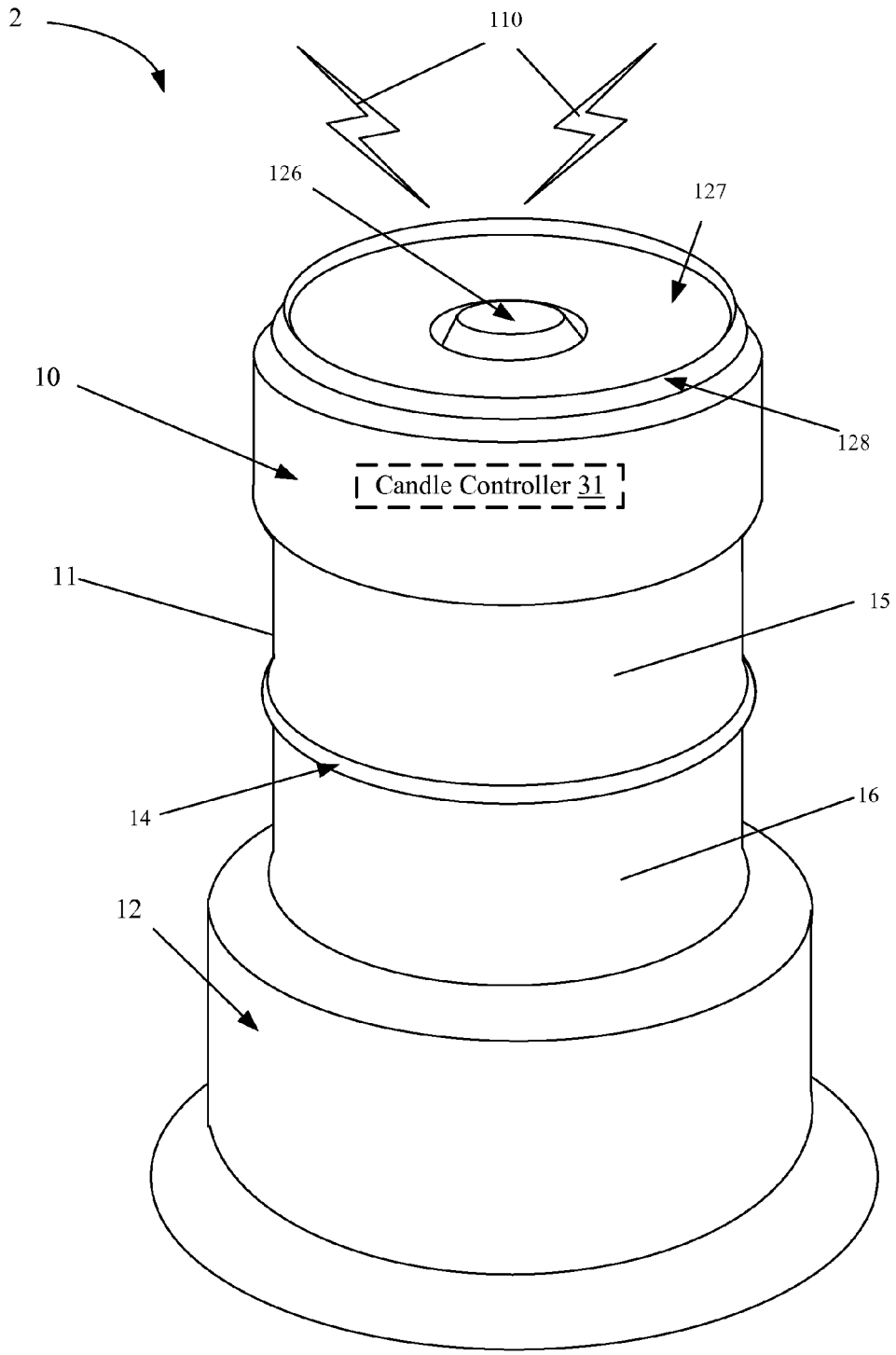
FIG. 1 is a perspective drawing of a candle device in accordance with the described embodiments.

In the following detailed description, numerous specific details are set forth to provide a thorough understanding of the concepts underlying the described embodiments. It will be apparent, however, to one skilled in the art that the described embodiments can be practiced without some or all of these specific details. In other instances, well known process steps have not been described in detail in order to avoid unnecessarily obscuring the underlying concepts.

Typically, electronic gaming machines can be provided with a game controller and a number of peripheral devices coupled to the game controller, such as monitors, printers, bill/ticket acceptors, lights and bonus mechanisms. The game controller can be configured to control the play of a wager-based game on the gaming machine including determining game outcomes using a random number generator and interacting with the peripheral devices to present the determined game outcome to a user of the gaming machine. The interactions between the game controller and the peripheral devices can involve sending commands and/or data to the peripheral devices and receiving status information from the peripheral device.

Because regulatory regulations that require a long and expensive approval process for introducing new game software, the gaming software used by the game controller to provide a wager-based game on the gaming machine is rarely updated once the gaming machine is deployed in the field, such as within a casino. Thus, once deployed, the functionality of the game controller is fixed and the game controller may not recognize the introduction of new devices and new features. It is desirable to provide upgrade capabilities in a gaming machine so that new features and functions can be introduced.

One approach to providing upgrade capabilities is to assume the gaming software on the game controller will be fixed and provide a secondary processor that is separate from the game controller whose software can be upgraded to add additional gaming functions. The secondary processor can be configured so that it doesn't perform wager-based game functions, such as the determination of an outcome for the wager-based game and an associated award. Since the secondary processor doesn't perform gaming functions, the software approval process for a device including the secondary processor is greatly simplified.

In some of the embodiments described herein, the secondary processor can be incorporated into a candle device. A candle device is typically mounted to the top cabinet of a gaming machine for maximum visibility. It includes a number of stages of different colors that are lit alone or in combination with other stages to convey information about a state of a gaming machine. For instance, often a candle device is configured to light up a stage of a particular color when an attendant is needed at the gaming machine. Traditional, candle devices include a simple controller for turning on-off different lighting stages in response to commands from a game controller. However, a processor and memory can be added to the candle device to greatly increase the functions that the candle device can perform. For instance, the processor can control additional peripheral devices, such as audio devices, image capture devices and display devices, integrated into the candle device as well as peripheral devices, such as bill validators, printers, displays and audio devices integrated into the main cabinet of a gaming machine. The peripheral devices can be controlled to add additional functionality to the gaming machine. In addition, the processor can be used to provide enhanced communication functionality, such as wireless communications between the gaming machine and remote servers or wireless communications with portable electronic devices carried by casino employees and patrons alike.

With respect to FIGS. 1-4, form factors for candle devices with enhanced processing capabilities that can be coupled to a gaming machine are described. The candle devices can be coupled to a game controller on the gaming machine as well as to one or more peripheral devices. In particular embodiments, some of the peripheral devices can be dual port devices where a first port is communicatively coupled to the game controller and a second port is communicatively coupled to the secondary processor on the candle device. Gaming machines including a candle device, dual port peripheral devices and a game controller coupled to one another in this manner are described with respect to FIGS. 5 and 6.

In one embodiment, the main touch screen display of the gaming machine that is used to output the wager-based game can be a dual port device. The game controller can be configured to send video content to the main display that allows a wager-based game to be played on the gaming machine. The secondary processor on the candle device can be coupled to the main display and configured to send supplementary video content to the main display. The secondary processor can be configured to control a size and position of a portion of the display allocated to showing the video content from the game controller and a size and position of a portion of the display allocated to showing video content from the candle device. The video content from the candle device that is output to the main display under control of the secondary processor can be used to add additional features to the gaming machine.

Figure 7A:
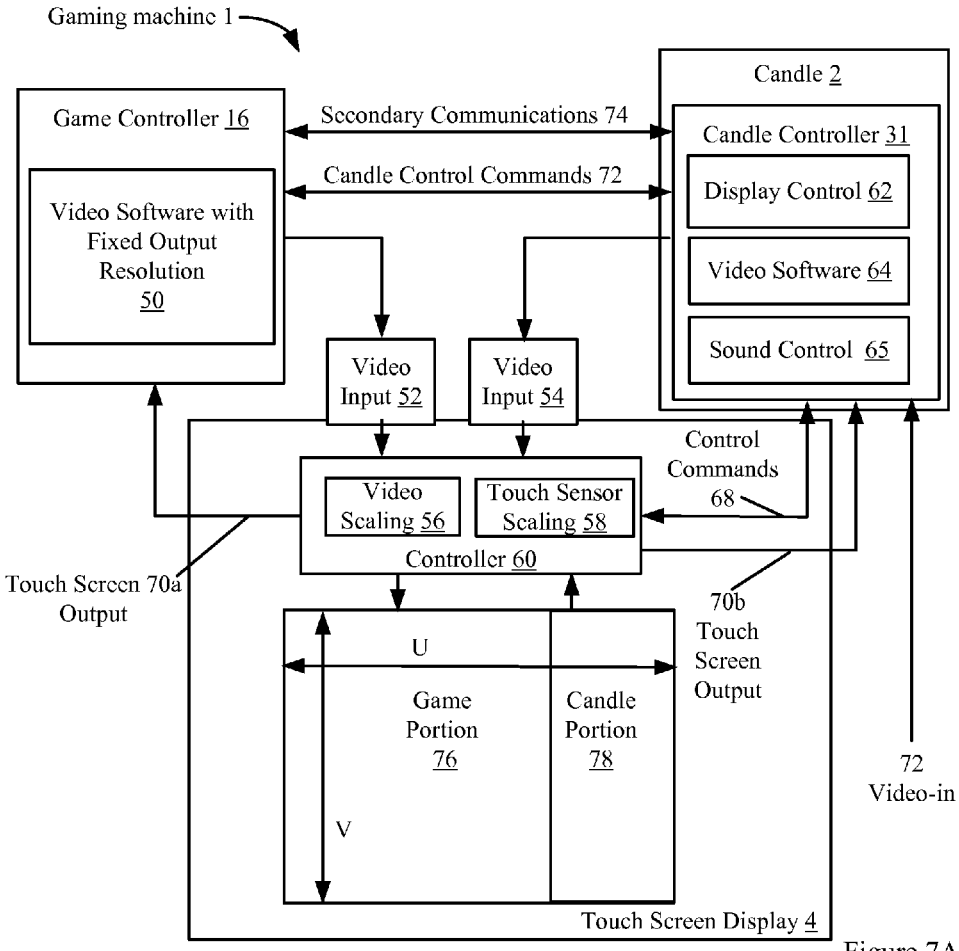
FIG. 7A is block diagram of a gaming machine including a dual port touch screen display communicatively coupled to a candle device in accordance with the described embodiments.
Figure 7B:
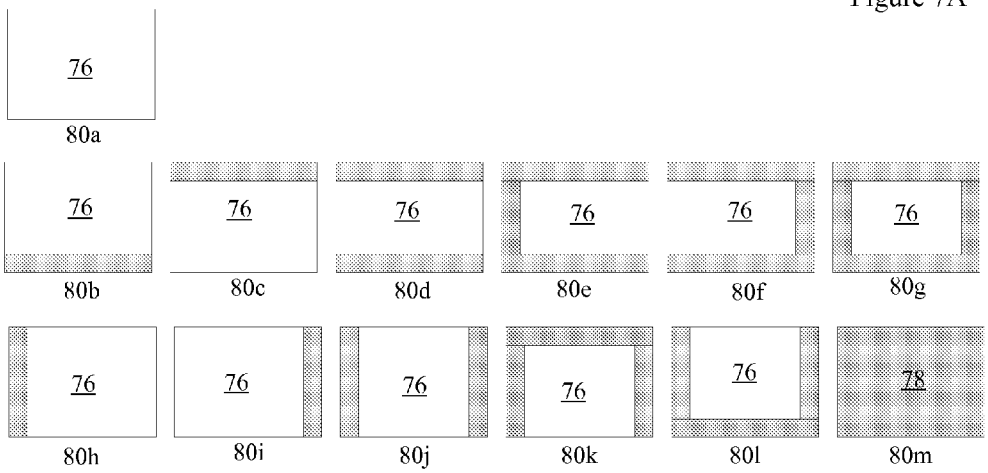
FIG. 7B is block diagram of picture in a picture modes for a dual port touch screen display in accordance with the described embodiments.
Figure 8:
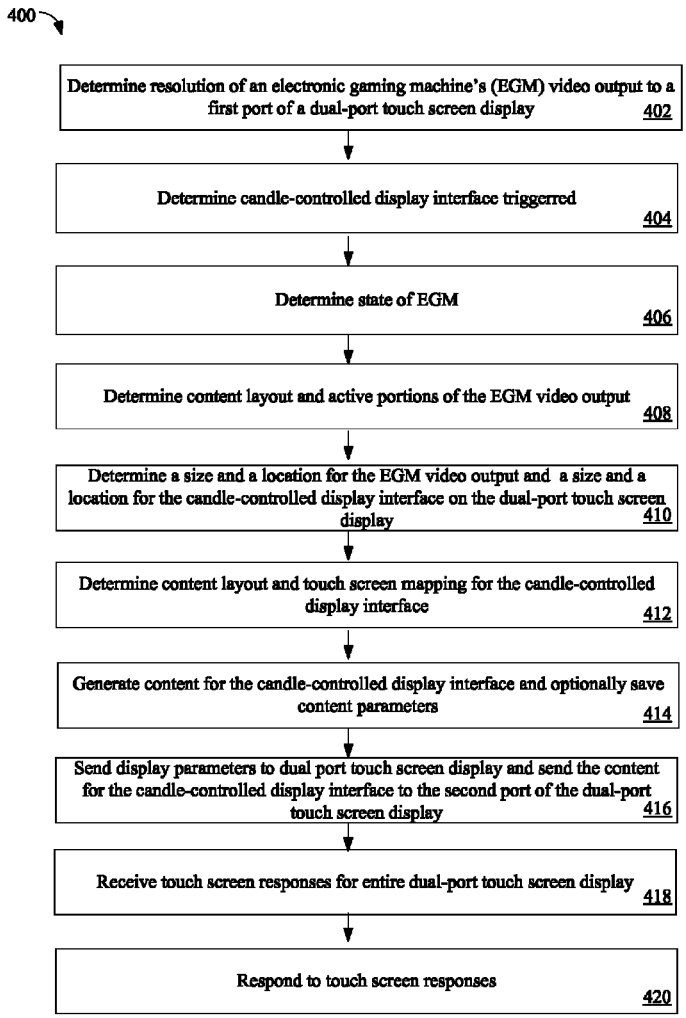
FIG. 8 is a flow chart of a method for controlling dual port touch screen display in accordance with the described embodiments.

With respect to FIGS. 7A, 7B and 8 methods and apparatus that allow a secondary processor to control and display content to the main touch screen display of a gaming machine are described. Examples of content that can be output via the secondary processor are described with respect to FIGS. 11C, 12A, 12B, 12C and 12D. In one embodiment, the secondary processor can be used to generate an interface on the main display that can enable verification of an electronic transaction involving an interaction between a gaming machine and a portable electronic device, such as a smart phone, carried by a player. As an example, the electronic transaction may involve an electronic transfer of funds to the gaming machine. Methods and apparatus related to the verification interface are discussed with respect to FIGS. 9, 10, 11A and 11B.

Candle Devices

With respect to FIGS. 1-4, details of candle devices including examples of external form factors and internal component arrangement are described. FIG. 1 is a perspective drawing of a candle 2 in accordance with the described embodiments. A portion of candle 2 can be used to provide lighting functions on a gaming machine, such as the lighting functions associated with a candle device on a gaming machine. Another portion of the candle can be used to provide enhanced gaming machine functionality, such as transaction verification, player tracking functions and wireless communication capabilities, which are discussed in more detail below.

The candle 2 can include an upper housing 10 that fits over a clear shell 11 that forms a middle portion of the housing. In one embodiment, the shell 11 can be cylindrical but other shapes are possible and the example of a cylinder is provided for illustrative purposes only. The shell 11 can be formed from a light transmitting material, such that light emitted from lighting elements (e.g., LEDs) disposed within the housing can be transmitted through the shell when the lights are activated. The shell 11 fits into a base 12, which serves as a lower portion of the housing.

In a particular embodiment, the upper housing 10, shell 11 and base 12 can be formed from a polycarbonate plastic. The upper housing 10 and base 12 can be metalized to provide a metal sheen if desired. In other embodiments, an opaque coating can be provided on portions of the housing, such as the upper housing 10 and the base 12. One or more divider rings, such as 14, can be placed over the cylindrical shell 11 to divide the shell into a number of stages, such as stages 15 and 16.

Each of the stages 15 and 16 can include lighting elements that are separately controlled. In one embodiment, the lighting elements can be used to provide candle functions, i.e., to convey information about the gaming machine to which it is coupled. For instance, stage 15 can be lit, stage 16 can be lit or both stage 15 and 16 can be simultaneously lit to convey information about the status of the gaming machine. If more than two stages are used, than additional combinations of lit stages are available to convey gaming machine status information.

The base 12 can include a mounting plate (not shown) that allows the candle 2 to be attached to a surface, such as an exterior surface of a gaming cabinet of a gaming machine. Often candle 2 can be mounted to the top of the gaming machine cabinet to increase its visibility. An aperture in the gaming cabinet can allow a wiring bundle, including power and/or data connections for the candle 2, such as a wiring bundle extended from base 12, to be passed through an exterior surface of the gaming machine cabinet and into the interior of the gaming machine cabinet.

In particular embodiments, the candle 2, depending on the number of stages, can be from 5.5 inches to 7.5 inches in height. For instance, a device with two stages can be about 5.5 inches in height, a device with three stages can be about 6.5 inches in height and a device with four stages can be about 7.5 inches in height. The lighting elements in each stage can be independently controlled so each stage can be lit by itself or in combination with other stages. When the candle is coupled to an electronic gaming machine, the combinations of lit stages can be used to convey information associated with the electronic gaming machine, such as a need for service.

The diameter of the shell 11 can be about 2 inches. The outer diameter of the upper housing 10 can be greater to or equal to the diameter of shell 11, such as between 2 and 3 inches. The outer diameter of the base 12 can vary from about 2 inches to 3 inches. In particular embodiments, the base can be about 1 inch in height. The height of the upper housing 10 can be from about 0.5 to 4 inches. In a particular embodiment, the height can be about 2.25 inches. In some embodiments, the dimensions of the candle 2 can be selected to conform to dimensions proscribed by regulations of a specific gaming jurisdiction. For instance, the regulations can specify a required height for a candle device.

In particular embodiments, sound and wireless communication capabilities can be provided with candle 2. Alternatively, the candle can be configured to control a remote audio device, such as speakers mounted to a gaming machine cabinet. In one embodiment, the remote audio device can also be configured to be controlled by a gaming controller. An example of this configuration is described in more detail with respect to FIG. 6. When the candle device is configured to control a remote audio device, the candle device 2 may or may not include a speaker mounted to the candle device 2.

In one embodiment, the upper housing 10 can include a top rim 128 where one or more speaker modules, such as 126, and an antenna 127 can be disposed within the top rim 128. The antenna 127 can be used to transmit and receive wireless signals 110. In a particular embodiment, a candle controller 31 can be integrated into the upper housing 10. The upper housing 10 can include a secure enclosure with anti-tampering mechanisms that make it difficult to access the candle controller 31. The secure enclosure can be located in other portions of the housing, such as base 12. Further, the candle 2 can include more than one secure enclosures surrounding system circuitry.

In particular embodiments, the secure enclosure including the candle controller 31 can be permanently sealed after the candle controller 31 is placed in the secure enclosure where opening the secured and sealed enclosure may require cutting through or breaking the outer portion of a structure forming the secure enclosure. A detection mechanism can be included that is configured to detect if the structure forming the secure enclosure is compromised. When the structure forming the secure enclosure is compromised, the candle device can be configured to notify the system of the event and possibly erase one or more memories.

In another example, the candle device can be configured to detect if the position of the upper housing 10, including candle controller 31, is changed relative to the middle portion of the housing 11. For instance, the candle controller 31 can be configured to detect if the upper housing is separated from or rotated with respect to the middle portion of the housing 11. This anti-tampering mechanism can be utilized when the candle controller 30 is located in another portion of the candle 2, such as the base 12.

In some embodiments, the circuitry forming the candle controller 31 can be integrated with the structure forming the secure enclosure such that the circuitry can be rendered non-functional if an attempt is made to access the secure enclosure. For instance, as described below with respect to FIG. 2, a circuit board associated with the candle controller 31 can be coupled to an inner support structure, such as central conduit 136, in such a manner that an attempt to twist or pull off the upper housing 10 will damage the circuit board and render it non-functional. Thus, preventing a person from accessing the controller 31 to install malevolent software and then re-installing it on the candle. Further details of candle controller functions and its disposition within a secure enclosure are described below with respect to the following figures and also with respect to U.S. patent application Ser. No. 12/943,789, previously incorporated herein by reference.

The candle controller 31 can include one or more general purposes processors and memories. In some instances, the candle controller 31 can be packaged in a more compact housing, such as a housing without the lighting functions associated with candle 2. For instance, the upper housing 10 including the candle controller 31 can be provided as a separate device without the lighting elements associated with stages 15 and 16. The controller 31 can still be coupled to a number of devices on a gaming machine and can still be used to provide one or more of the gaming functions described herein. Other form factors for an enclosure surrounding the candle controller 31 are possible and the cylindrical form factor associated with upper housing 10 is but one example. Next, some examples of the internal configuration of a candle device, such as device 2, are described with respect to FIG. 2.

Figure 2:
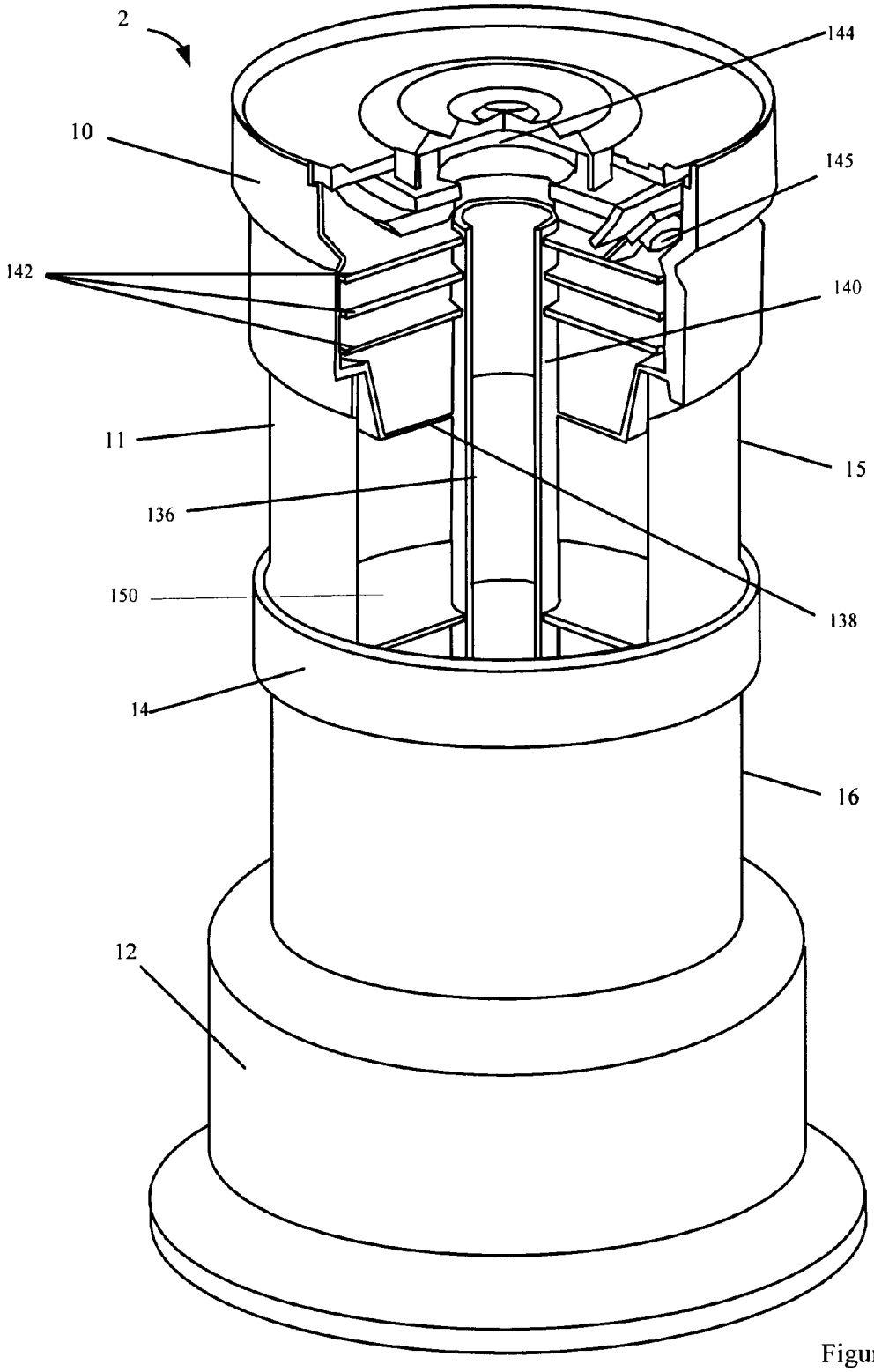
FIG. 2 is a perspective drawing of a candle device including an internal cross section in accordance with the described embodiments.

FIG. 2 is a perspective drawing of a candle 2 including a partial cut-away of a top portion of the housing 10. As described with respect to FIG. 1, the candle 2 includes two stages, 15 and 16, separated by the divider 14. In one embodiment, the candle controller includes 3 PCBs 142, disposed in different horizontal planes. In other embodiments, the candle controller can include one or more PCBs. When multiple PCBs are utilized, one or more connectors between the PCBs can be used to transfer data between the boards.

The upper housing 10 includes a bottom portion 138. The bottom portion includes an aperture that allows a center conduit 136 to extend through the bottom portion 138 and into an interior portion of the upper housing 10. The bottom portion 138 separates the enclosure including the controller from the two lighting stages 15 and 16 disposed beneath the enclosure. The central conduit can be anchored to the base 12 of the candle 12.

In one embodiment, the one or more PCBs, such as 142, can be coupled to an outer surface 140 of the central conduit 136. For instance, the PCBs can be glued to the outer surface 140. In addition, the one or more PCBs can also be coupled to upper housing 10. In this configuration, an attempt to move the upper housing 10 relative to the central conduit 136, such via twisting or pulling the upper housing 10, can damage the one or more PCBs and possibly render the circuitry on the one or more PCBs non-functional.

When the one or more PCBs are coupled to the central conduit 136, a sensor can be provided for detecting stresses in the central conduit. Thus, stresses resulting from attempts to twist or pull the upper housing 10 the upper housing relative to the central conduit. The sensor can be used to trigger an alarm with a stress above a certain threshold is detected.

Power and data connections can run through the center conduit from the housing 10 such that connections are formed with the one or more PCBs in the housing. The power connection can be used to supply power to the candle controller. The data connections can allow for bi-directional communication between the candle controller and one or more remote devices. Further, the data connections can allow for bi-directional communications between peripheral devices disposed in different portions of the candle 2, such as lighting elements in each of the stages 15 and 16 and peripheral devices located in the base 12.

The central conduit 136 can include apertures that allow power and/or data connections to extend through the side of the conduit. For instance, an aperture can be provide in the central conduit at each of the stages 15 and 16 to allow power and data connections to extend from the conduit 136 to peripheral devices located in each stage, such as the lighting elements located in each stage. In addition, the power and data connections routed through the center conduit 136 can be connected to a wiring harness that extends from the base 12. The end of the wiring harness can include one or more connection interfaces. The one or more connection interfaces can couple the candle to an external power source and external communication links. The communication links can allow the controller to communicate with and receive data from devices, such as a game controller, a value input device or a value output device disposed within a gaming machine cabinet to which the candle device 2 is mounted. Details of the wiring harness are discussed below with respect to FIG. 3.

Each lighting stage, such as stages 15 and 16, can include a number of lighting elements. The lighting elements in each stage can be enclosed to prevent light from lighting elements from one stage from bleeding into another stage. For example, the divider 150 can be composed of an opaque material that prevents light from stage 15 from bleeding into stage 16 when the lighting elements in stage 15 are activated.

The lighting elements within a stage can be arranged to provide a relative even distribution of light in all directions. Coatings can be applied to the interior surfaces within each stage, such as the outer surface of central conduit 136, a top surface of divider 150 and a bottom surface of the bottom portion 138 can be coated to prevent shadowing effects. Further, a diffusive layer can be applied to an inner surface of shell 11 to generate a more even distribution of light emitted from the candle 2. In one embodiment, the diffusive layer can be colored so that each lighting stage appears a particular color when the lighting elements are activated within the stage where the color of the diffusive layer can vary from stage to stage.

In other embodiments, the diffusive layer can be white and each stage can include lighting elements that emit light of a particular color to give each stage its color. In some embodiments, each stage can include lighting elements of different colors where each of the colored lighting elements can be activated alone or in combination with lighting elements of different colors to change the color of each stage. The colors of each stage used in a candle 2 can vary from jurisdiction to jurisdiction. Thus, a candle with stages configurable with different colors can allow the candle to be used in multiple jurisdictions.

In one embodiment, a speaker assembly 144 can be mounted to the housing 10. The speaker assembly 126 can provide sound generation capabilities for the candle device 2. In the example shown in FIG. 2, the speaker assembly 144 forms a top portion of the upper housing 10 and part of a secure enclosure for the candle controller 31. In alternate embodiments, a speaker assembly, such as 144, can be located in an interior portion of the candle device 2 where it is mounted in proximity of an inner surface of the housing for the candle device 2. The inner surface of the housing can include apertures that allow sound emitted from the speaker assembly to be transmitted through the housing. For instance, a cap with apertures can be placed over the speaker assembly 144. In various embodiments, the candle device 2 can be provided without a sound generation device or can be provided with multiple sound generation devices.

One or more antennas for receiving and transmitting wireless communication can be integrated into the candle device. For instance, an antenna can be integrated into the top portion of the speaker assembly 144. This configuration can be used to communicate with wireless access points mounted above the candle 2, such as wireless access points mounted in a ceiling above the candle device 2. In general, one or more antennas can be provided at different locations within the candle device 2. For instance, a second antenna can be provided in the upper housing 10 that is orientated for communicating with mobile devices generally located beneath the candle 2, such as for communicating via Bluetooth™ or Wi-Fi™ related communication protocols.

The candle device 2 can include one or more image capture devices, such as camera 145. The image capture devices can be configured to capture still images or video data. Multiple image capture devices can be used to increase a field of view relative to the candle. In one embodiment, multiple image capture devices can be used to provide a 360 degree view around the candle 2. In other embodiments, a number of image capture device can be primarily orientated in a direction towards the front of a gaming machine to capture the activity of a person in front of the gaming machine and possibly on adjacent gaming machines.

In one embodiment, the image capture device can include an adjustable zoom feature. Adjustment mechanisms can be coupled to the image capture device 145 to allow its orientation relative to the housing 10 to be altered. In one embodiment, the adjustment mechanisms can be externally accessible. For instance, one or more screws can be provided such that when each screw is actuated, the position of the camera is altered in a different direction. For instance, actuating one screw can result in tilting the camera 145 up or down while adjusting another screw can result in the camera moving from side to side. To provide external access to the screws, holes can be provided in the upper housing 10. In other embodiments, the camera 145 can be coupled to a motor that allows the position of the camera to be adjusted via remote commands.

In alternate embodiments, the candle device 2 can be coupled to a remote image capture device. For instance, image capture device can be mounted to a player tracking unit installed within a gaming machine cabinet, a card reader installed within the gaming machine cabinet or at some other location on the gaming machine cabinet, such as within a top box. A wired or wireless communication connection can be implemented between a controller within the candle device 2 and the image capture device. In one embodiment, the image capture device can be used in conjunction with the image capture device 145 located within the candle device. In another embodiment, the image capture device can replace the image candle device 145 such that the candle device no longer includes a camera mounted within its housing.

Figure 3:
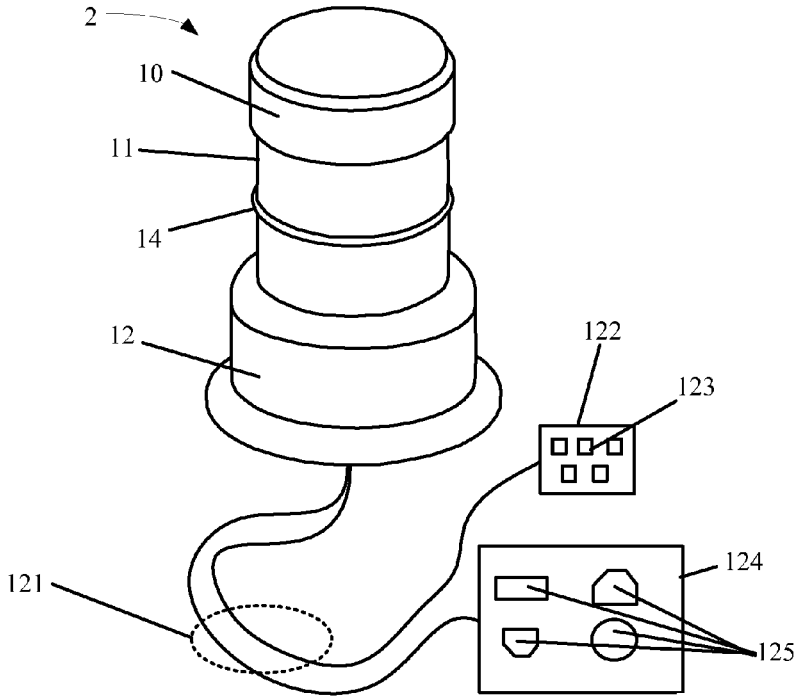
FIG. 3 is a perspective drawing of a candle device including a wiring harness in accordance with the described embodiments.

FIG. 3 is a perspective drawing of a candle 2. A wiring harness 121 can extend from the base 12. The wiring harness can include a number of wires coupled to connectors, such as 122 and 124. The connectors can include data and/or power interfaces, such as 123 and 125. Via the data and/or power interfaces, a candle controller, lighting elements and other peripheral device disposed within the interior of the candle 2 can receive power and send and/or receive data. In one embodiment, the candle 2 can be configured to receive external power and then condition the received power. The conditioned power can then be output and received by another device via one of the connectors. For instance, a powered USB interface can be provided on one of the connectors 122 and 124.

In a particular embodiment, the wiring harnesses can include a primary connector 122 and a secondary connector 124. The primary connector 122 can be used to connect a legacy power and data connections on a gaming machine. It is shown as a single component but can comprise multiple components. The legacy power and data connectors can vary from gaming machine to gaming machine and the primary connector 122 can take different forms to allow for compatibility with different gaming machines. As an example, the primary connector 122 includes five apertures 123 for compatibility with legacy communication and data connections on different gaming machines. The compatibly provided by the legacy power and data connectors can allow an existing candle device on a gaming machine to be replaced with the candle device 2.

The secondary connectors 124 can be used to add new data and power connections on a gaming machine and to reconfigure existing data and power connections on a gaming machine. The secondary connector 124 can include power and/or data interfaces, such as but not limited to four different communication and/or data connections 125. The form factor of the secondary connectors including the number and types of connections that can provided can be varied and are provided for the purposes of illustration only. Examples of power and/or data connections that may be included in a secondary connector include but are not limited to USB, DVI, HDMI, Ethernet, an audio jack, composite video, fiber optic, RS-232, RS-422, RS-485, component video, VGA, RGB, digital audio, IEEE-1394, IEC, PS/2, PCI express, PCI, PCI-X, RJ45, RJ11, ATA, SCART and S-Video.

In one embodiment, the candle 2 can include a power switching device 150. The power switching device 150 can be configured to allow power to be cut and then restored for one or more gaming devices on the gaming machine. In one embodiment, the candle device 2 can be configured to cycle power for the entire gaming machine. The power cycling can be implemented in response to a command received from an external device. The commands can be encrypted and other protocols can be used to prevent an unauthorized person from sending the command to the candle device 2. In one embodiment, a mobile application can be configured to generate an authorization message to begin the power cycling on the gaming machine via the candle device 2.

Figure 4:
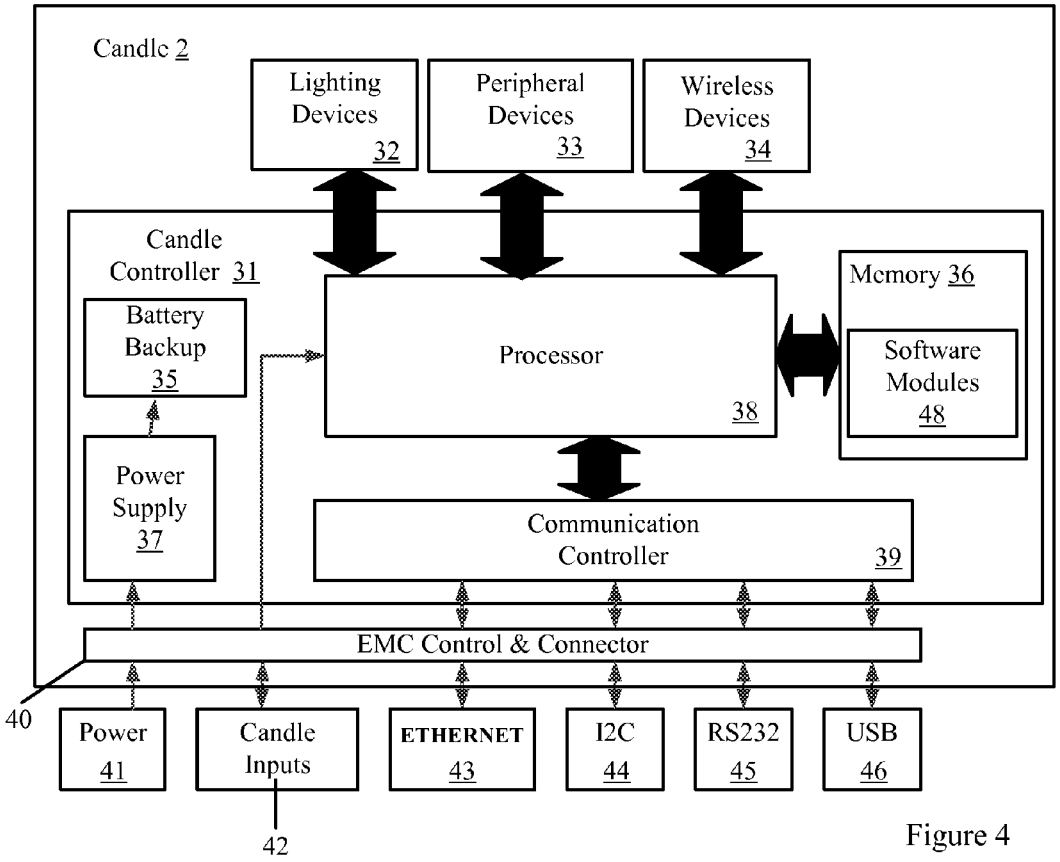
FIG. 4 is a block diagram of a candle device in accordance with the described embodiments.

FIG. 4 is a block diagram of a candle 2 including a candle controller 31. In one embodiment, all of the inputs and outputs to the candle 2 pass through an EMC control & connector component 40, providing electromagnetic compatibility limiting unwanted emissions from the candle 31 and limiting the susceptibility or immunity from unplanned electromagnetic disturbances. This type of connector may be required to conform to EMC standards such as FCC Parts A & B, IEC, and CSAA. To thwart the security of a gaming machine, individuals have been known to generate electromagnetic disturbances to gaming machine components. Further, an electrostatic potential can be build up on a person that is discharged into a gaming machine when the person touches the gaming machine. The EMC control 40 can prevent unwanted electromagnetic occurrences generated on the candle 2 from propagating to devices disposed within the interior of a gaming machine cabinet to which the candle 2 is coupled.

The power input 41 can be configured to provide the input voltage source for the candle power supply 37. Typically, input voltages range 12V to 24 VDC. When the candle 2 is used with a gaming machine, the power input 41 can come from an internal power supply within the gaming machine's cabinet. The power supply 37, which is coupled to the power input 41, provides the various output voltage sources for the internal circuits of the candle. In one embodiment, the candle 2 can include voltage conversion circuitry, such as step down circuitry that enables devices requiring varying voltages less than the input voltage to be supplied with power. The stepped down voltages can be provided to devices internal to the candle or to devices coupled to the candle via one of its power and/or data interfaces, such as a USB device coupled to the candle via interface 46. In one embodiment, the power supply 37 can be coupled to a battery backup 35 and used to provide the charging voltage source for the battery backup circuit 35.

Many gaming jurisdictions require certain devices, such as security monitoring circuitry on a gaming machine, to include a battery backup in case of casino or machine power failure. Further, the gaming jurisdictions can require a back-up transmission method for receiving data preserved and/or gathered during a power failure. The machine power failure could be a result of a main power grid failure or a local machine power failure that resulted from an attempted security breach (e.g., deliberately cutting power to the gaming machine) or other reasons. The security monitoring circuitry can be configured to detect and store any attempt to open any gaming machine door during the power failure. The monitoring circuits are typically part of the gaming machine's components. In one embodiment, the monitoring circuits can be linked to the candle.

A battery backed-up transmission method can be configured to provide a way to communicate security information during or immediately upon a power-up. In one embodiment, the method can allow for limited communications even during the power-interruption, such as an alert that a security related event is now in progress or that power has been lost to the gaming machine. The power-up can process can be initiated any time a gaming machine loses power, such as after a gaming machine is moved within the casino, transferred to another location outside the casino or following a power failure. The battery backup 35 can be used to provide a power back-up for one or more of the memories within the candle and provides a timing wake-up input to the candle control 31 and wireless control 34 to store and communicate any security information received at the candle from remote sensors, such as sensors within a cabinet of a gaming machine from which the candle can receive information, or security information detected from sensors associated with the candle 2. For instance, an image capture device in the candle 2 can be used as a sensor to gather security information. As another example, sensors can be associated with a secure enclosure including the candle controller 31 that are configured to detect an attempt to access the secure enclosure. The timing set point for the wake-up can be minutes or hours depending on jurisdictional or/and operator requirements.

In one embodiment, all of the communication channels routed through the candle interface with the communication controller 39. The communication channels can be associated with pass through communications, such as communications from an external device routed to the gaming machine via the candle or communications generated at the game controller, player tracking controller or a peripheral device and sent to a remote device via the candle. For instance, pass through communication can include a communication from a game controller on a gaming machine to a remote server that is passed through the candle 2 to allow the communications to be transmitted wirelessly to the remote sever. Further, communications sent from the processor 38 or sent to the processor 38 can be routed through the communication controller 39. As described above, the candle 2 can be configured to engage in bi-directional communications with various devices on a gaming machine (e.g., see FIGS. 5 and 6 and their associated description.

These communications channels may support various communication protocols. Thus, the processor 38 can be configured to parse and generate messages associated with various communication protocols. For instance, the communication channels can be used to implement one or more of Ethernet 43, I2C 44, RS-232 45 and/or USB 46. Other communication protocols that may be used are RS-485, IEEE 1394 (Firewire), Netplex and other standard or proprietary communication interfaces used in the gaming industry as well as the computing industry. If available, these channels can be implemented as wired or wireless embodiments. For instance, a wireless communication protocol, such as wireless USB, can be implemented to allow for wireless communications between the candle and other devices within the gaming machine. Besides, wireless communications, wireless power transmission may also be supported in candle 2.

Depending on the number of gaming systems to which a gaming machine is connected (see FIG. 9), some gaming machines may utilize only a single external communication channel connection while others may utilize multiple channels. The communication controller 39 can be configured to provide the non-intrusive multiplexing and de-multiplexing of the communication interface data. Thus, the communication controller can be implemented with no change or interference to any protocol or related data from or to the gaming machine. The non-intrusiveness can allow an existing gaming machine to be equipped with a candle 2 utilized for external communications purposes without altering existing gaming software, such as regulated gaming software used by a gaming controller on a gaming machine or gaming system software used by back-end servers coupled to the gaming machine, as well as without interference between protocols or related data from or to the gaming machine. In additional embodiments, the communication controller 39 can be configured to detect player messages from a player tracking unit and communicate with devices, such as servers associated with a player tracking system.

The processor 38 can be coupled to a memory, such as a RAM. The processor 38 can be configured to load programs stored in memory 36, such as software modules 48, to the RAM for execution. In one embodiment, the processor 38 can include one or more ARM processors, but other types of CPUs can also be utilized. An operating system for the processor 38 can also be stored in the memory 36.

The programs executed by the processor 38 can be configured to provide the operational control for the candle 2. For instance, the controller 31 can execute programs to control lighting devices 32 and peripheral devices (e.g., a camera, a microphone, a display, an audio device disposed on the candle 2). In addition, the controller 31 can control one or more wireless interfaces that allow the candle 2 to communicate wirelessly with external devices, such as mobile devices carried by players or casino employees or remote servers. The wireless interfaces can include one or more transceivers.

In particular embodiments, the processor 38 can be configured to receive software and/or firmware upgrades for itself, a game controller on the gaming machine and/or peripheral devices on a gaming machine from a remote device. The candle controller 31 can include functions for verifying the authenticity of downloaded firmware and/or software. Further, it can include hardware or software for decrypting the downloaded firmware and/or software. In general, the candle controller 31 can include hardware and/or software for encrypting and decrypting in-coming or outgoing communications.

The candle controller 31 can be configured to connect to one or more different legacy candle inputs 42 and communicate via a communication protocol associated with the legacy candle inputs 42. The legacy candle inputs can be associated with different gaming machine designs from different gaming manufacturers. In one embodiment, the legacy candle inputs are connected to a port of the controller 31. The legacy candle inputs can be utilized when the candle is installed as part of a retrofit of a gaming machine deployed in the field. However, the legacy candle inputs 42 can also be used to connect the candle to a gaming machine in a factory setting as part of a new gaming machine.

In an alternate embodiment, the cabinet module can be provided that includes a number of connection interfaces, such as connection interfaces for the power 41, the candle inputs 42, the Ethernet 42, the I2C 44, the RS-232 45 and the USB 46. In operation, the cabinet module can be disposed within the cabinet of a device, such as a cabinet of a gaming machine. As an example, the data and power interfaces 123 and 125 associated with the primary and secondary connectors, 122 and 124, respectively can be integrated into the cabinet module. The cabinet module can be coupled to the external portion of the candle device 2 as shown in FIG. 3.

The cabinet module can include one or more processors and memory in addition to processors that are located in a secure enclosure in the external portion of the candle device 2. The functions described with respect to the candle controller 31 can be distributed between processors located in the external portion of the candle device and processors located in the cabinet module. In one embodiment, the secure enclosure in the external portion of the candle device can at least include a processor for performing wireless functions associated with the candle device 2.

In a particular embodiment, the processor in the cabinet module can be coupled to a memory storage device within the cabinet module. In one embodiment, the memory storage device can be a solid state drive. The processor can be configured to only write data to the memory storage device if it is received from a remote server via the wireless communication connection from the external portion of the candle device 2 or the Ethernet port 43. The Ethernet port 43 allows the processor to communicate with a remote server via a wired Ethernet connection.

Further, the processor in the cabinet module can be configured to only copy data from the memory storage device and send it to the remote server via the wireless interface and/or the Ethernet connection 43. If an attempt is made to copy data from the memory storage device or write data to the memory storage device, via an alternate communication port, such as the USB 46 or RS-232 45 port, the processor can be configured to perform a remedial action that prevents copying data from or writing to the memory storage device. For example, the processor can be configured to reboot the candle device in response to detecting a copy or write to the memory storage device via an unauthorized port. The reboot can be triggered as long as a device is attempting to copy or write from the unauthorized communication port.

For example, if a USB dongle is connected to the USB port 46 an attempt is made to write data from the dongle to the memory storage device or an attempt is made to copy data from the memory storage device. The processor in the cabinet module can be configured to cause the candle device to repeatedly reboot as long as the USB dongle remains coupled to the USB port 46 and is attempting to write or copy data from the memory storage device. When the device is removed, the candle device can finish the boot condition and return to a regular operating condition. However, it can be configured to report the attempt to a remote device, such as a remote server that communicates with the candle device wirelessly when communications are restored with the remote device. The feature described above can also be implemented for memory storage devices located in the enclosure associated with the external portion of the candle 2, such as a memory storage device on one of the boards 145 shown in FIG. 2.

As another security feature, the processor in the cabinet module can be configured to constantly maintain communications with one or more processors in the externally mounted candle device. When the processor in the candle device can't be detected by the processor in the cabinet module, the processor can be configured to trigger an error condition. The error condition might trigger a remedial action, such as shutting down or rebooting the candle device. When remote communications are restored to the processor in the cabinet module, such as via a wireless communication connection, then the processor in the cabinet module can report the error condition to a remote server.

In addition, a remote server can also be configured to constantly maintain communication with one or more processors in the externally mounted candle device and/or the processor in the cabinet module. If the processor in the externally mounted portion of the candle device can't be detected and/or the processor in the cabinet module can't be detected by the remote server, then the remote server can log an error condition and trigger a remedial action. For instance, when a processor in the external or internal portion of the cabinet device can't be detected, the remote server can be configured to send a message to a security person to investigate the gaming machine including the candle device with the cabinet module.

Gaming Machines Including Candle Devices

Figure 5:
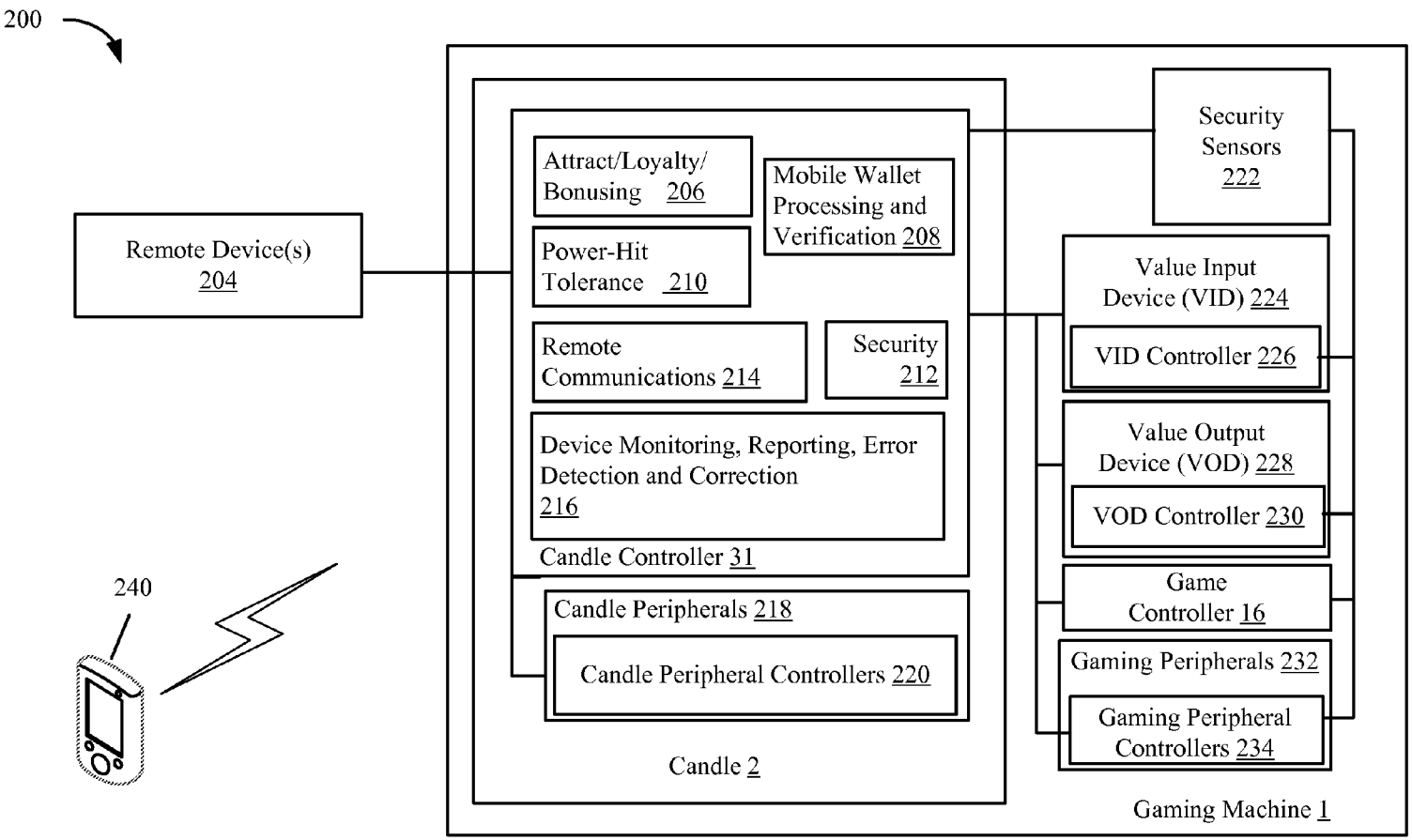
FIG. 5 is a block diagram of a gaming machine including a candle device in accordance with the described embodiments.
Figure 6:
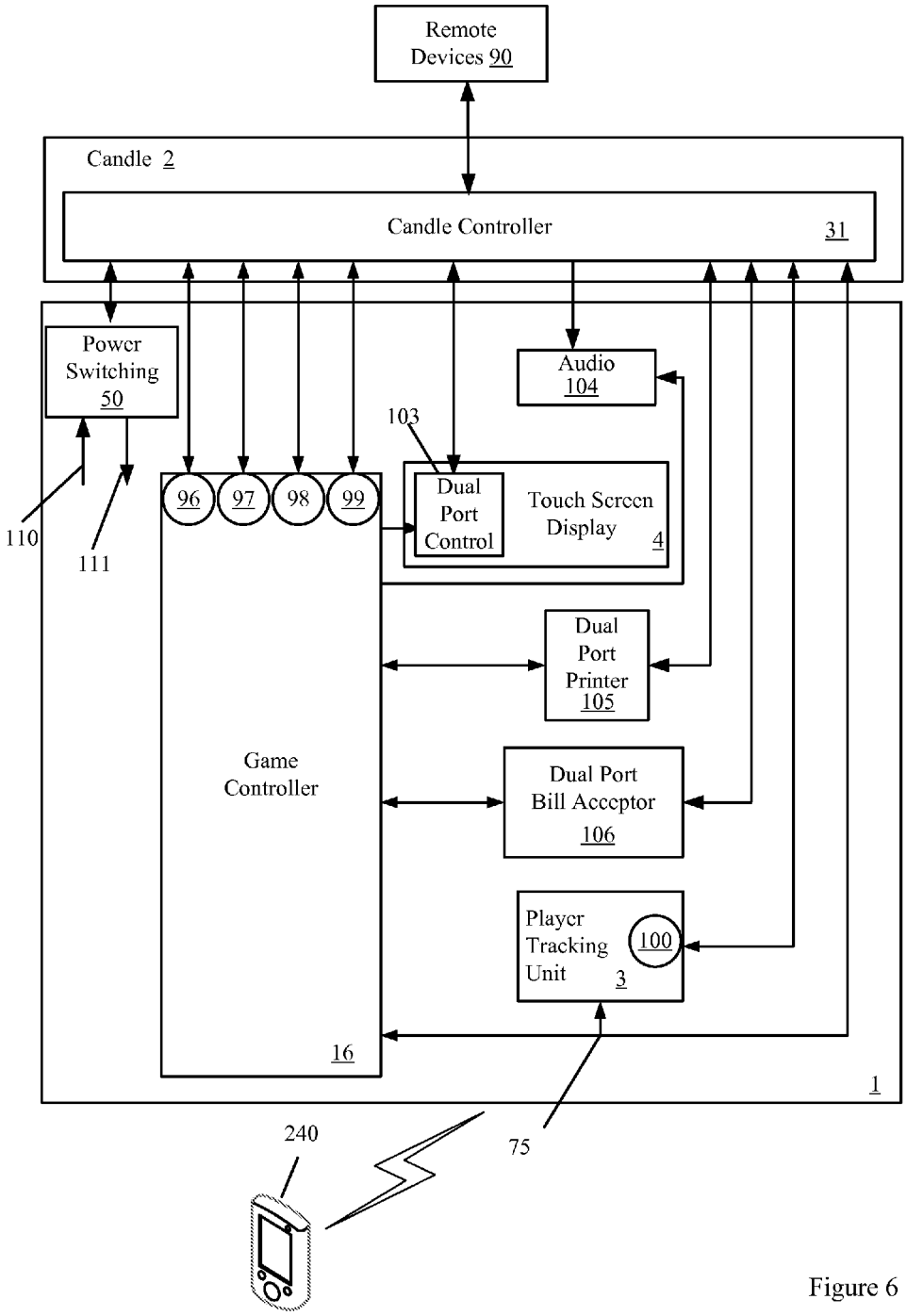
FIG. 6 is a block diagram of a gaming machine including dual port devices communicatively coupled to a candle device in accordance with the described embodiments.

Next, with respect to FIGS. 5 and 6, details of gaming machines including the candle devices described above and interactions between the candle device and various gaming machine components are presented. FIG. 5 is a block diagram of a gaming machine 1 including a candle device 2 in accordance with the described embodiments. The candle 2 can be configured to communicate with one or more remote devices, such as 204, mobile devices, such as 240, and devices associated with the gaming machine 1, such as the game controller 16, security sensors 222, a value input device 224, a value output device 228 and other gaming peripherals 232. The candle 2 can include a candle controller 31 for controlling the communications with the various devices A number of peripheral devices 218, such as but not limited displays, audio devices, cameras and lighting arrays can be associated with the candle 2. The candle controller 31 can be configured to control the peripherals 218 via communications with peripheral controllers 220 associated with each peripheral. In particular embodiments, the controller 31 can be configured to the control the peripherals in conjunction with commands and/or data received from one or more remote devices, such as 204. For instance, the remote server 204 can send a message to the controller 31 for output to a display associated with the candle 2.

The candle controller 31 can include a processor and memory (see FIG. 4) that is programmable to perform various functions. The functions can be related but are not limited to 1) security 212, 2) device monitoring, reporting, error detection and correction 216, 3) remote communications 214, 4) attract, customer loyalty programs and bonusing 206 and 5) power-hit tolerance 210. In various embodiments, the functions provided by the controller 31 can be modified or changed in response to receiving a download of software and/or firmware from a remote device.

The controller 31 can be configured to communicate with a value input device (VID) 224 via its VID controller 226 and a value output device (VOD) 228 via its VOD controller 230. The value input devices 224 and the value output devices 228 are gaming peripherals that are used to add or remove value from the gaming machine 1. Via a VID, value can be added to the gaming machine to allow wagers to be mad on a wager-based game. Via a VOD, any value remaining on the gaming machine 1 can be removed, such as value accrued via successful wagers, can be removed.

The security functions 212 can be related to monitoring security devices associated with just the candle such as security sensors associated with a secure enclosure and/or cameras located on the candle 2. Further, the candle controller can be configured to monitor security sensors associated with the gaming machine 1, such as sensors 222 associated with locks on the gaming machine 2. As described above, the remote communications 214 can involve sending communications from the candle 2 to remote devices. In a particular embodiment, the communications can be sent via a wireless communication interface.

The attract and bonusing features 206 can involve performing functions associated with a loyalty program, such as player tracking program. In particular embodiments, the controller 31 can be configured to perform functions often associated with a player tracking unit, such as associating game play on the gaming machine with a particular player, receiving and displaying player identification information and transferring free play credits to the gaming machine 1. Further details of loyalty related functions, such as the use of a dual port display to generate a player tracking interface are described with respect to FIGS. 11 and 12A-D.

The power-hit tolerance 210 can be used to preserve data in the event of a loss of power or a power fluctuation on the gaming machine 2. As described above with respect to FIG. 4, the controller 31 can include a back-up power source. In the event of a power failure, the controller can be configured to operate with some data storage and communication capabilities using the back-up power source until power is restored to the gaming machine 1. As an example, the power-hit tolerance function can be used to preserve data generated from one or more the gaming peripherals 232, a VID 224 or a VOD 228.

The device monitoring, reporting, error detection and correction 216 can be associated with managing maintenance issues associated with peripheral devices, such as a VID 224 or a VOD 228. Currently, unless an error condition that requires a technician to intervene occurs, maintenance schedules on VIDs and VODs on a gaming machine 1 are usually based on average reliability predictions, i.e., every device is treated the same. Therefore, some devices can be scheduled for maintenance when they do not need it while other devices may not receive maintenance when it is needed. Maintenance of VIDs and VODs can be labor intensive, which is costly to operators. Further, while a device is being maintained, revenues are not generated on the gaming machine 1, which is also costly. Therefore, scheduling a device for maintenance that does not need it is costly to operators. However, not providing maintenance to device that needs it can also be costly. The device monitoring, reporting, error detection and correction 216 can be configured to provide better maintenance scheduling for devices, such as 224 and 228, on the gaming machine 1.

Examples of value input devices can include but are not limited to bill and ticket acceptors, coin acceptors and card readers. Via one or more of the VIDs, a value amount associated with a bill, ticket, coin, a card or an electronic wallet carried by the player can be added to the gaming machine. Examples of value output devices can include but are not limited to ticket printers, card writers and coin dispensers. Via one or more of the VODs, a value amount can be removed from the gaming machine 1. For instance, a value amount removed from the gaming machine 1 can be associated with 1) a ticket dispensed from a ticket, 2) coins dispensed from a coin dispenser, 3) a value written to a portable instrument, such as a credit card or a hand-held device like a cell phone, or 4) a value transferred off the gaming machine 1 to a remote account via an electronic fund transfer from the gaming machine 1 associated with an electronic wallet carried by a player. The fund transfer can be associated with an electronic wallet carried by the player.

In one embodiment, value transactions, such as fund transfers associated with an electronic wallet can benefit from additional verification. For example, a bill validator on the gaming machine 1 can be configured to initiate an electronic funds transfer associated with a player's mobile wallet. The mobile wallet can be an electronic wallet associated with the player's mobile phone or tablet computer. In one embodiment, the game controller 16 can be configured with software that doesn't recognize the mobile wallet functions provided by the bill validator. Instead, the candle 2 can be configured to handle the processing.

The processing of transaction involving a mobile wallet can involve communications with remote servers and verification of the transaction. These mobile wallet processing and verification functions can be generated via 208. Further details of mobile transactions including verification are described below with respect to FIGS. 6, 9, 10 and 11.

FIG. 6 is a block diagram of a gaming machine 1 including dual port devices communicatively coupled to a candle device 2 in accordance with the described embodiments. The embodiment in the block diagram of FIG. 6 shows the optional elements of a dual-port bill acceptor 106, a dual-port printer 105, a touch screen display 4 with dual port control 103, a dual port audio system 104, and a monitoring connection 75 of the player tracking panel 3. Dual port capability can be used to provide a non-intrusive method of maintaining system integrity and provide additional gaming features.

In a dual port device, a first port can be used to provide the existing communication peripheral interface from the gaming machine to the dual port device. The game controller 16 and the peripheral device can communicate via the first port in a manner fixed by the use of regulated gaming software executed by the game controller and regulated software and/or firmware used by the peripheral device. The second port can be used to provide an enhanced interface with the controller 31. The second port on the dual port devices may be connected to the candle controller 31 via an appropriate interface, such as one of the interfaces associated with the wiring harness shown in FIG. 3. In particular embodiments, the controller 31 can be configured to receive commands and/or data from remote devices that are sent to the dual port devices via the second port. Further, the controller 31 can be configured to receive data from the dual port devices that are sent to one or more different remote devices via one of the communication interfaces, such as a wireless communication interface, on the candle 2.

The dual port touch screen display 4 can be configured to receive video content from each of the game controller 16 and the candle 2. In one embodiment, the dual port control 103 on the display 4 can be configured to receive sizing, scaling and positioning commands that allow content received from multiple sources to be displayed in different portions of the display. The sizing, positioning and scaling commands can result in content sent to the display 4 to be output in a stretched or a compressed format relative to the native resolution in which content the content is generated The dual port control 103 can be configured to generate translation functions for the video input and for the touch screen output that interpolates the video input to fit within a designated display area and interpolates the touch screen output to account for positioning and scaling commands received from an external device. In alternate embodiments, the candle controller 31 can be configured to perform the translation functions.

The touch screen display 4 can be the main display the gaming machine 1 where video content associated with a wager-based game generated by the game controller 16 is displayed. The game controller 16 can be configured to output the video content in a native resolution, such as 640 by 480. The video content can include indications of locations where a touch detected by a touch screen can cause the game controller 16 to perform an action in response. For instance, in response to a detected touch, the game controller can change the video content output to the touch screen display 4.

In one embodiment, the touch screen display 4 can be a replacement display such that it replaces the display installed in the gaming machine during manufacture. When used as replacement display, the touch screen display 4 can have a resolution that is greater than the native resolution in which the video content output by the game controller 16 is generated. For instance, the touch screen display 4 can have resolution of 1280 by 960 while the native resolution of the content output by the game controller 16 is 640 by 480. When a display technology with a fixed pixel size, such as an LCD, is used as the replacement display, interpolation and/or smoothing can be utilized to scale the content output from the gaming controller 16 to fit the resolution size of the display.

As described above, the dual port controller 103 can be configured to receive sizing, positioning and scaling related commands. In one embodiment, only the candle controller 31 is configured to generate these sizing, positioning and scaling related commands and not the game controller 16. For instance, the candle controller 16 can be configured to select picture in a picture modes that allows the video content output from game controller 16 to be displayed on different portions of the touch screen display 4 at different resolutions where the native resolution output by the game controller 16 and sent to the touch screen display 4 is constant.

The sizing, scaling and positioning commands can be associated with picture-in-picture (PIP) capability of the display 4. Using the PIP capability, video content can be transmitted from the candle and displayed as a PIP mode on the display 4. In one embodiment, the video can be transmitted via a USB interface. Via the candle 2, the PIP capability can be used to output real-time or stored video for the player.

In one embodiment, the candle 2 can control the PIP independently from the game controller 16. Thus, the game controller 16 is not aware that the video content that it is outputting is affected by PIP commands issued by the candle 2 or that the candle 2 is sending control commands to the display 4. In another embodiment, the game controller 16 can transfer or allow control of the display by the candle 2. As an example, the game controller 16 can be configured to hand over control to the candle 2 to allow it to display a bonus game presentation on all or a portion of the touch screen display 4. Thus, game controller 16 can engage in bi-directional communications with the candle 2 to indicate when the display is available and the candle 2 can communicate when it is finished using the display. When the candle 2 indicates it has completed displaying the bonus game presentation, the game controller can reassume control of the display. When the game controller 16 controls the display, it may prevent the candle controller 31 from outputting content to the display 4. Further details of the control of the dual port touch screen display 4 coupled to a game controller 16 and a candle controller 31 are described below with respect to FIGS. 7A, 7B and 8.

Communication links, which can be wired or wireless, are shown between communication interfaces TITO (Ticket-In/Ticket-Out) 97, link progressive 98, WAP 99, and player tracking 100 and associated communication interfaces on the controller 31. In this example, the communication interfaces are associated with the controller 31. In general, a gaming machine deployed in the field can be configured to interface with one or more external systems where the number of systems varies from gaming machine to gaming machine. For instance, a first gaming machine can be configured to interface with a wide area progressive system, a player tracking system and a cashless system while a second gaming machine can be configured to communicate with only a cashless system. The candle 2 can include multiple ports to provide communication support for gaming machines configured to communicate with different numbers of external systems.

The controller 31 can be configured to provide the multiplexing of the data streams received from the gaming machine 1. The resultant data stream can then be encrypted and sent to one or more remote devices 90. Further, the candle 2 can be configured to receive communications from one or more remote devices where a portion of the communications is in an encrypted format and decrypt the encrypted portions of the communications. The decrypted data can be sent to the respective communication interfaces of the gaming machine 1, such as 97, 98, 99 and 100.

Power switching 50 can receive power via interface 110 and output power via interface 111. One or more of the game controller 16, the audio device 104, the display 4, the dual port printer 105, the dual port bill acceptor 106 and the player tracking 3 can be connected to the power switching 50. The power switching 50 can be controlled in response to commands received from the candle controller to interrupt power to the one or more devices connected to the power switching 50 as part of a power cycling event. In one embodiment, the candle controller 31 can configured to cycle all of the devices on a gaming machine including or except for itself. A power cycling event may be initiated to clear an error condition on one of the devices. In one embodiment, the candle controller 31 can be configured to initiate the power cycling in response to a command received from one of the remote devices 90.

The dual-port bill acceptor 106 can be configured to read tickets (TITO) and paper currency and communicate this information on the first port, which is controlled by the regulated game program. JCM Global (Las Vegas, Nev.) is one example of a manufacturer that provides dual-port bill acceptors. The dual-port bill acceptor 106 can also be configured to read special promotional tickets and communicate this information on the second port to the candle 2. In addition, the dual-port bill acceptor 106 can provide cash and operational information to the casino operator on the second port to the candle 2. The controller 31 can be configured to send this information received from the bill acceptor to a remote device.

In one embodiment, the dual-port bill acceptor can be configured to perform electronic transactions involving a mobile device, such as 240. The electronic transactions can involve a mobile wallet application where the information received from the mobile device is used to initiate a transfer of funds to the gaming machine 1 from one of the remote devices 90. The candle controller 31 can be configured to provide communication services that allow the mobile wallet transaction to be processed. Further, the candle controller 31 can be configured to generate an interface on display 4 that allows data associated with the transaction to be input, output and verified. Details of the interface are described with respect to FIGS. 10 and 11.

The dual-port printer 105 can be configured to print tickets (TITO) provided by data on a first port, which is controlled by the regulated game program, or special promotional tickets provided by data on a second port. The promotional tickets can be customized and regularly updated. In one embodiment, the tickets can be personalized based upon an identification of a player at the gaming machine. In addition, the dual-port printer can be configured to provide operational information to the casino operator on a second port. FutureLogic (Glendale, Calif.) is one example of a manufacturer of dual port printers.

The audio channel on the dual port audio system 104 can be used to provide the ability to use the existing game machine audio speakers to provide voice and audio for the player that is not part of the game program. Further, the second port can be used to provide audio that is part of a bonus game presentation that is generated by the candle 2. The player tracking monitoring port can be used to provide non-intrusive monitoring of the player tracking data to provide player ID information for the casino operator. In one embodiment, this data can be utilized by the candle 2 to provide custom content to a player. For instance, the player ID data can be used to target a personalized promotional opportunity selected based upon known information about the player. The personalized promotional opportunity can include a custom ticket that is printed by the printer. The customized ticket can include custom graphics and player identification information, such as the player's name.

In particular embodiments, when a dual port device, such as the bill acceptor 106 includes regulated software, such as regulated firmware, the regulated software can be decoupled from other software on the peripheral device. The regulated portion of the software may govern interactions between the peripheral device and the game controller 16. Changing the regulated portion of the peripheral software typically requires a lengthy approval process.

The non-regulated portion may involve interactions that do not involve the game controller 16 and thus, a gaming control board may allow this portion of the software to be updated without regulatory approval or under a much less stringent approval process. In various embodiments, the unregulated or less regulated portion of the peripheral software can be updated via the controller 31. For instance, if a new fraud detection algorithm is needed, such as to detect a new type of counterfeit currency, then the new detection algorithm can be downloaded to the bill acceptor via the second port of the dual port bill acceptor. If necessary, the power on the dual port bill acceptor can be cycled to allow the bill acceptor to restart using the new software or firmware.

Candle Devices Configured to Generate Display Interfaces on a Gaming Machine

Next, methods and apparatus for generating the display interfaces on a gaming machine are described with respect to FIGS. 7A, 7B and 8. In a particular embodiment, a dual port touch screen display device described above with respect to FIG. 6 can be coupled to a game controller and a candle controller allowing the display to receive and to display simultaneously content from both the game controller and the candle controller. To provide a display interface, the candle controller can be configured to respond to touch screen data associated with selectable buttons (active areas) in the content output by the candle controller to the display as is described in more details as follows.

FIG. 7A is block diagram of a gaming machine 1 including a dual port touch screen display 4 communicatively coupled to a candle device 2. As described above, the game controller 16 can be configured via a first communication interface to send candle control commands 72 to the candle 2. In response to receiving the commands, the candle controller 31 can turn on or turn off various lighting elements on the candle. As described above, a combination of lighting elements that are lit on the candle can be used to convey information about the gaming machine 1, such as an attendant is needed at the gaming machine. In addition, via a second communication interface, the candle controller 31 can be configured to monitor messages sent to or from the game controller 16 devices. In one embodiment, the candle controller 31 can be configured to communicate directly with the game controller 16 to request information 74, such as accounting, player tracking information or information related to its current state.

The dual port touch screen display 4 can include a number of display modes that allow video content from the game controller 16 and the candle controller to be simultaneously output from the display 4. Some examples of display modes are illustrated in FIG. 7B. In a particular embodiment, the touch screen display 4 can include at least two video inputs, 52 and 54, for receiving video data. In one embodiment, the game controller 16 can be configured to send video content to the touch screen display 4 via the video input interface 52 and the candle controller 31 can be configured to send video output to the touch screen display 4 via the video input interface 54.

The touch screen display 4 can be EST model manufactured by Digitech Systems co. LTD (Korea). Examples of screen sizes include 15, 17, 19 and 23 inch models. The controller 60 can also be provided by Digitech Systems (e.g., a DTC-01N or the DTC-02S-02). The controller 60 can support a proprietary serial communication protocol, such as Netplex or an open protocol, such as USB.

In particular embodiments, the first video input interface 52 can be a VGA or DVI compatible interface. As examples, resolution from about 640×480 up to 1920×1080 can supported. The 1920×1080 can support an HD signal. The aspect ratios of the input from the game controller can be one of 4:3, 16:9, 16:10 and 5:4. The second input interface 54 can also be a VGA or DVI compatible interface. For instance, the candle controller 31 can provide a DVI signal at 1280×1024 resolution.

The touch screen display 4 has a native resolution, such as U by V pixels. For instance, the resolution of the touch screen display 4 can be about 1280 by 960 pixels where U=1280 and V=960. The touch screen display 4 can include a controller 60 that is configured to receive commands that allocate a portion of the display 4 to video content provided from the game controller 16 and video content provided by the candle controller 31. In FIG. 7A, the portion of the display 4 allocated to content from the game controller 16 is referred to the game portion 76 and the portion of the display 4 allocated to content from the candle controller 31 is referred to as the candle portion 78.

The content output to the display by the game controller 16 or the candle controller 31 can include active areas where a touch input detected by the touch screen can result in response by the game controller 16 or the candle controller 31. The game controller 16 can be configured to receive touchscreen output 70*a* from a controller 60 associated with the display 4. Based upon the touchscreen output 70*a* received from controller 60, the game controller 16 can determine whether any active areas of the touch screen have been selected. The candle controller 31 can also be configured to receive touch screen output 70*b* from the controller 60. Based upon the touch screen output 70*b*, the candle controller 16 can determine whether any active areas of the touch screen have been selected.

In one embodiment, the video input, touch screen output and control commands 68 can be communicated via separate interfaces. For instance, video content from the controller 31 can be sent to the display 4 via a first interface, such as 54, control commands 68 can be sent to the display 4 via a second interface and touch screen output can sent to the controller 31 via a third interface. In other embodiment, a common interface can be used to communicate video content, control commands and touch screen output between a particular device, such as the game controller 16 and the candle controller 31, and the display 4. For instance, a first USB interface can be used to communicate video content, control commands 68 and touch screen output 70*b* between the controller 31 and the display 4.

In particular embodiments, the display 4 can utilize a display technology, such as a LCD technology, where a pixel size associated with the display is fixed. The native resolution of a LCD, LCoS or other flat panel display refers to its single fixed resolution. As an LCD display consists of a fixed raster, it cannot change resolution to match the signal being displayed as a CRT monitor can. Thus, optimal display quality can be reached only when the signal input matches the native resolution of the display 4. An image where the number of pixels is the same as in the image source and where the pixels are perfectly aligned to the pixels in the source is said to be pixel perfect. For instance, a 640×480 image mapped to a 640×480 portion of an LCD can be considered pixel perfect.

When the signal input doesn't match the native resolution of the display interpolation is used. Interpolation (scaling of the image) causes a loss of image quality. When the resolution of the video content received by the display 4 is smaller than the native resolution of the display it can be scaled up. When the resolution of the video content received by the display is larger than the native resolution of the display it can be scaled down. In one embodiment, the interpolation can be performed by the video scaling 56 in the controller 60. In another embodiment, the candle controller 31 can be configured to receive video content from the game controller 16, scale it to fit a resolution on the display to which it is to be output and then send the scaled video content to the display 4.

The display 4 can include a controller 60 configured to receive control commands that affect a size and a position of the game portion 76 and the candle portion 78. In a particular embodiment, only the candle controller 31 and not the game controller 16 is configured to generate and send control commands 68 to the controller 60 that affect the size and the position of the game portion 76 and the candle portion 78. In one embodiment, the display 4 can be configured to only receive control commands from one device. In the candle controller 31, the display control 62 can be configured to determine the size and the position of the game portion 76 and the size and the position of the candle portion 78. Unless a size selected for the game portion 76 is pixel perfect, the size of the game portion 76 selected by the candle controller 31 can affect how the video content from the game controller 16 is interpolated onto the display 4 and hence, a quality of the subsequent image that is displayed.

The image quality that is displayed after interpolation on the display 4 can be affected by the resolution of the video content generated by the game controller 16 and the size of the game portion 76 selected by the candle controller 31 where some sizes selected for the game portion 76 can produce better interpolation results and hence, a higher output image quality than other sizes. In particular embodiments, the candle controller 31 can be configured to determine the resolution of the video content output from the game controller 16 and select a size for the game portion 76 to produce better interpolation results.

In various embodiments, the candle controller 31 can determine the resolution of the video content output from the game controller 16 in a number of different manners. For instance, it can retrieve the information from a memory location on the candle controller 31 where it was previously stored, it can request the information directly from the game controller 16 or it can request the information from a remote server. The candle controller 31 may receive information from the game controller 16 and/or a remote server, such as information that identifies the model of the gaming machine 1, which allows the candle to determine the resolution of the video content generated by the game controller 16. Based upon the determined resolution of the content output by the game controller 16, the candle controller 31 can determine parameters for scaling up and/or down the content on the display 4.

The touch screen display 4 can be configured to generate different a number of different display modes that affect a size of the game portion 76 and the candle portion 78. As described above, in one embodiment, only the candle controller 31 can be configured to provide commands that select a display mode to utilize on the display 4. As examples, the display 4 can be configured to provide all or a portion of the display modes 80*a*-80*m* illustrated in FIG. 7B where the candle controller 31 determines which of these display modes to use at a particular time. These display modes are described as follows.

In display mode 80*a*, all of the display 4 is allocated to the game portion 76 whereas in display mode 80*m*, all of the display 4 can be allocated to the candle portion 78. In display mode 80*b*, a top portion of the display 4 is allocated to the game portion 76 and a bottom horizontal strip is dedicated to the candle portion 78. In 80*c*, a top horizontal strip is allocated to the candle portion 78 and a bottom portion is allocated to the game portion 78. In 80*d*, a top and a bottom horizontal strip are allocated to the candle portion 78 and a center portion is allocated to the game portion 76. In 80*h* a left vertical strip is allocated to the candle portion 78 and the remaining portion is the game portion 76. In 80*i*, a right vertical strip is allocated to candle portion 78 and the remaining portion is the game portion 86. In 80*j*, left and right vertical strips are allocated to the candle portion 78 and the center portion is allocated to the game portion 76.

The candle controller can be configured to select a thickness for the left and/or right vertical strips or the top and/or bottom horizontal strips. In one embodiment, when two or more strips are selected, such as a top and a bottom horizontal strip, the candle controller 31 can select the strips to be of the same thickness (horizontal strip) or width (vertical strip). In another embodiment, the candle controller 31 can select the thickness/width of the strips to be different sizes.

In 80*e*, a top and a bottom horizontal strip and a left vertical strip are allocated to the candle portion 78 and remaining portion is allocated to the game portion. In 80*f*, a top and a bottom strip and a right vertical strip are allocated to the candle portion 78 and the remaining portion is allocated to the game portion. In 80*k*, a left and a right vertical strip and a top horizontal strip are allocated to the candle portion 78 and a remaining portion is allocated to the game portion 76. In 80*l*, a left and right vertical strip and a bottom horizontal strip are allocated to the candle portion 78 and a remaining portion is allocated to the game portion 76. In 80*g*, a top and bottom horizontal strip and a left and right vertical strip are allocated to the candle portion 78 and a center portion is allocated to the gaming portion.

In 80*m*, the candle portion 78 is rectangular and allocated the entire display such that none of the video content from the game controller 16 is visible on display 4. In alternate embodiments, a smaller rectangle can be used for the candle portion 78 such that the game portion 76 is only partially obscured by the candle portion. A disadvantage of this approach is that the candle portion 78 needs to be positioned and placed such that it doesn't obscure any important information associated with the game portion 76 such as the outcome of a wager-based game displayed in the game portion 76. Thus, using this type of picture in a picture mode, the candle controller 31 may need to determine at any given time the content that is displayed in the game portion 76 to avoid obscuring it with an overlapping candle portion 78.

In one embodiment, the candle controller 31 can be configured to utilize only display modes that never overlap and obscure the game portion 76. For instance, the candle controller 31 can be configured to utilize display modes 80*a*-80*l* in FIG. 7B where the game portion 76 is rectangles of different sizes. The video content associated with the game portion 76 can be scaled to fit the different size rectangles but is never partially covered by the candle portion 78. Further, the candle controller 31 can select the scaling parameters such that the content displayed in the game portion 76 is an acceptable quality after scaling to allow information associated with the content, such as a game outcome, to be adequately displayed to a player. An advantage of this approach is that the candle controller 31 doesn't have to determine the current content of the game portion 76 when selecting a display mode that allows video content associated with the candle portion to be displayed, such as display modes 80*b*-80*l*.

As described above, the touch screen display 4 can be a retrofit display that replaces the original display that was installed during manufacture of the gaming machine where the touch screen display 4 can have a different resolution than the resolution of the video content generated by the game controller 16. For example, the resolution of the video content can be 640×480 while the resolution of the replacement display can be 1280×960. In a particular embodiment, the resolution of the replacement display can be larger than the resolution of the video content and the candle controller 31 can be configured to select a display mode where the resolution of the game portion 76 for the display is always greater than or equal to the resolution of the video content generated by the game controller 16. Thus, the content is displayed pixel perfect or in a scaled up format. For instance, if the resolution of the video content generated by the game controller is 640×480 then the minimum U dimension selected by the candle controller 31 is greater than or equal to 640 and the minimum V dimension selected by the candle controller 31 is greater than or equal to 480. In one embodiment, the candle controller can be configured to only select a picture perfect (no scaling) for the content from the game controller 16.

When the U an V dimensions are selected as described in the previous paragraph, the video content generated by the game controller 31 can be stretched (interpolated) in the U, V or both U and V directions when it is displayed in the game portion 76. However, the video content generated by the game controller 31 is never shrunk below the resolution output by the game controller 31 in the U and V directions. It may not be desirable to scale down the video content generated by the game controller 31 below the resolution in which it is output from the game controller 16 because shrinking causes data to be removed from the image and hence information to be lost.

Returning to FIG. 7A, the game controller 16 can include software 50 for generating the video content sent to the display 4. In one embodiment, the output resolution of the software 50 can be fixed such that video content with the same resolution is sent independent of the size of the game portion 76 selected by the candle controller 31. The video content which is sent from the candle controller 31 to the display 4 can be generated by the video software 64. In particular embodiments, the candle controller 31 can be configured to generate video content with different resolutions depending on a size and a format of the candle portion 78 selected by the candle controller. For instance, the candle controller 31 can be configured to select a size of the candle portion 78 and then generate content that is pixel perfect with the size of the candle portion.

In one embodiment, the candle controller 31 can be configured with a maximum resolution for the content output. For instance, the maximum dimension of a strip can be 120×1024. The candle controller 31 can select a strip with smaller dimensions, 60×1024. However, the candle controller will not select a strip with larger dimensions, such as 150×1024. When the smaller dimensions are selected, the content sent to the display 4 will be the maximum resolution, such as 120×1024. After receiving the content, controller 60 can be configured to scale down the content to a smaller resolution, such as 60×1024.

In one embodiment, the candle 2 can receive video signals 72 including audio from a remote device. For instance, the video signals can be associated with a live sports event or live broadcast television. In addition, the video signals can be associated with pre-recorded content, such as previously aired television shows, theater movies, music videos or Internet content (e.g., youtube videos). The video software 64 can be configured to integrate video signals from one or more video feeds into the video content output in the candle portion 78. Examples of a candle portion 78 including content from a video feed are described with respect to FIGS. 11C and 12C.

Sounds can be associated with the video content output from the candle controller 31. For instance, a video feed for a live sporting event displayed in the candle portion 31 can include commentary associated with the sporting event. The sound control 65 associated with the candle controller 31 can be configured to output the sounds associated with the video content. In one embodiment, the sounds can be output via an audio device, such as a speaker associated with the candle 2 (e.g., see FIG. 1). In another embodiment, the sounds can be output via an audio device associated with a gaming machine, such as a dual port audio device (e.g., see FIG. 6). In yet another embodiment, the candle 2 can be configured to output the sounds via a device carried by a player such as a Bluetooth™ headset or via headphones coupled by wire to an audio output jack on their cell phone. In one embodiment, the controller 31 can generate an interface in the candle portion 78 that allows a player to choose a method for outputting sounds associated with the video content form the controller 31, change the volume of the sound and/or mute the sound.

As described above, the video content associated with the game controller 16 and the candle controller 31 can include a number of active areas where in response to touch screen input received in the active areas, the game controller 16 or the candle controller 31 can generate a response. The touch input associated with an active area is received when the touch screen is activated above a location where the active area is output on the display 4. To respond properly to a touch, the active areas displayed in the video content need to be mapped to corresponding locations on the touch screen, i.e., the receiving devices determines that a touch input received at a particular location and detected by the touch sensor corresponds to an active area displayed at the location on the display 4.

Typically, the game controller 16 will expect to receive touch screen output that corresponds to a game portion 76 filling the entire display screen (e.g., display mode 80*a*). The game controller 16 may not be aware of changes in size and position of the game portion on display 4 that can affect the locations where the touch sensor detects input for a particular active area that is output to the display 4. Thus, when the video content associated with the game portion 76 is output in window size and with a location different from a full screen mode, the touch screen output 70*a* sent to the game controller 16 may no longer match the locations of active areas expected by the game controller 16. To account for changes in position and size of the game portion, a transformation operation can be performed that interpolates the input received by the touch screen on display 4 for a particular size and position of the game portion to an input expected by the game controller 16. These transformation operations are discussed in more detail in the following paragraphs.

The controller 60 can be configured to scale the touch screen output 70*a* sent to the game controller 16. For instance, the candle controller 31 can be configured to provide a resolution of the video input 52 from the game controller 16 and a resolution of the game portion 76 to the controller 60 where the resolution of the game portion 76 can be different from the resolution of the video content from the game controller 16. Using this input, the controller 60 can be configured to interpolate the touch screen results to match the resolution of the video content of the game controller 16. As an example, the resolution of the game portion 76 can be 960×720 and the resolution of the video content from the game controller 16 can be 640×480 and the controller 60 can be configured to scale touch inputs received in the 960×720 game portion 76 to the 640×480 size. After scaling, the touch screen output 70*a* can be sent to the game controller 16 in the 640×480 size. As shown in FIG. 7B, the game portion 76 can be positioned at different locations on the display 4. The controller 60 can be configured to account for the position of the display portion 76 when performing the scaling. For instance, the game controller 16 can expect the touch screen input to start in the lower left hand corner of the display 4 and the controller 60 can be configured to scale the touch screen output so that it appears to start from this location. In alternate embodiments, the candle 2 can be configured to perform this scaling and then send the scaled results to the game controller 31.

In one embodiment, the candle 2 can be configured to receive the touch screen output 70*b* for the entire display including the game portion 76 and the candle portion 78 while the game controller 16 only receives the touch screen output 70 from the game portion 76 scaled to the resolution of the video content from the game controller 16. The candle controller 31 can be configured to determine if any of the touch screen input corresponds to active areas associated with video content generated and output to the display in the candle portion 78. When candle controller 31 detects that a location on the touch screen sensor has been activated that corresponds to an active area in the video content generated by the candle controller 31, the candle controller can perform an action in response. For instance, in response to detecting touch sensor data that corresponds to an active area, the candle controller 31 can generate new video content in the candle portion 78 and/or rearrange the content in the candle portion 78. Further, details related to the content generated in the candle portion 78 and altering the content in response to touch screen data are described with respect to FIGS. 11A-12D.

In particular embodiments, the candle 2 can be configured to save and/or send touch input associated with the game portion 76 to a remote device. The touch input associated with the game portion 76 can be in the scaled or non-scaled format. The remote device can be configured to determine whether the touch screen input is associated with any active areas generated by the display when the touch screen data was received. To make this determination, the candle 2 can also be configured to send information related to a state of the wager-based game generated by the game controller 16 to the remote device, such as whether the gaming machine is in an idle state, displaying an outcome to a game, between games or in a bonus state. Further, the candle 2 can be configured to send to the remote device information regarding details of the game output by the game controller, such as a particular version of a video slot game by a particular manufacturer. The state information can be used by the remote device to determine what content is associated with the touch input and whether any active areas have been selected.

In response to determining an active area has been selected in the game portion, the remote device can send commands to the candle that cause the candle controller 31 to alter the content output to the candle portion 78. For instance, in response to detecting a see pays button being activated in the game portion 76, the remote device can be configured to send commands to the candle controller 31 to output additional video content in the candle portion 78 for a supplementary bonus game generated by the candle controller 31. In another embodiment, when remote device determines a selection of a particular symbol in a bonus game generated by the game controller 31 has been selected, the remote device can send commands to alter the content displayed in the candle portion 78. For instance, in response to detecting the selection, the remote device can command the candle controller 31 to output video content associated with a supplementary bonus game that can include an additional award being provided to the player that is separate from the award associated with the bonus game generated by the game controller 16.

In another example, the remote device can command the candle controller 31 to generate a bonus presentation that augments the bonus presentation provided by the game controller 16. The supplementary bonus game presentation generated by the candle controller 31 can include time relevant information. For instance, if the bonus game from the game controller is triggered during a super bowl weekend or Saint Patrick's Day, then the bonus game from the candle controller 31 can include a super bowl theme or a Saint Patrick's Day theme that complements the bonus game output by the game controller 31.

In alternate embodiments, the functions performed by the remote device can be performed by the candle controller 31. Thus, the candle controller 31 may not have to send the touch screen output associated with the game portion 76 to the remote device. For instance, the candle controller 31 can be configured to determine that a bonus game has been triggered, is displayed in the game portion 76 and that a particular symbol selection associated with the bonus game has been made. In response to the determination, the candle controller 31 can be configured to generate and output a supplementary bonus game presentation to the candle portion 78.

In one embodiment, the touch screen display can support a multi-touch capability. For instance, the controller can be configured to detect and report two touch inputs on the touch screen moving towards one another or moving away from one another. The candle controller 31 can be configured to respond to the multi-touch output. For instance, in response to the detection of two touch inputs moving together, the candle controller 31 can be configured to reduce the size of or close the candle portion 78 or close a menu in the candle portion. Whereas, in response to the detection of two touch inputs moving away from one another, the candle controller 31 can be configured to open the candle portion 78 or open/expand a menu in the candle portion.

Next with respect to FIG. 8, a method 400 for a candle device to control a dual port touch screen display is described. As described with respect to FIG. 7A, the dual port touch screen display can be coupled to both a game controller on a gaming machine and a candle controller in the candle device. The candle controller can be configured to control a display mode associated with the touch screen display that affects the size and location of where content generated by the game controller and content generated by the candle controller is output to the touch screen display.

In 402, the candle controller can be configured to determine the resolution of a gaming machine's video output to a first port of a dual port touch screen display. The candle controller can be coupled to a second port of the dual port touch screen display. In 404, the candle controller can determine a candle-controlled display interface is triggered. Examples of candle controlled display interfaces are described with respect to FIGS. 11A-12D. In 406, in response to detecting the display interface is triggered, the candle controller can be configured to determine a state of the EGM.

In one embodiment, the state of the EGM can affect whether the display interface is generated on the touch screen display. The candle controller can be configured to not generate a display interface during certain states of the EGM, such as when the outcome presentation to a wager-based game is being dynamically output to the touch screen display. For instance, if the video reels for a video slot game are currently being output as spinning on the display, the candle controller can be configured to wait until the presentation is complete (i.e., the reels stop spinning) before generating the triggered display interface.

In another embodiment, in 408, the state of the EGM can be used by the candle controller or a remote device to determine whether a touch screen input, in area where the game content from the game controller is being output, is associated with an active area of the game content. The active area of the game content can be related to such functions as displaying the "pays" associated with the game, initiating a game, making game decisions (e.g. holding particular cards) or making a choice associated with a bonus game (e.g., selecting or more bonus symbols from among a number of bonus symbols that are displayed).

In response to determining the touch screen input is associated with an active area, the candle controller can be configured to perform a supplementary action that can affect the content output to the display from the candle controller. For instance, when it is determined one or more particular cards have been held in a card game output by the game controller, the candle controller can be configured to output a supplementary bonus game to the touch screen display or provide the opportunity for a side bet based on the held cards. The game controller responds to the touch input as it normally does and is not affected by the supplementary response performed by the candle controller. For instance, if the game controller determines that a see pays button has been selected, the game controller can generate a see pays screen which is output to the display. As another example, if the game controller determines that particular cards have been held in a card game, the game controller will proceed with normal play of the game independently of whether or not the candle controller, in response to certain cards being held, generates and outputs content related to a side bet or a supplementary bonus game.

In 410, the candle controller can be configured to determine a size and location for displaying the EGM video output and a size and a location for a candle-controlled display interface on the dual port touch screen. As describe above, the determination can involve selecting a display mode including a game portion and a candle portion for the touch screen display. The size of the game portion can be selected to preserve a display quality of the game content. For instance, the size of the game portion can be selected to be pixel perfect or a non-pixel perfect size can be selected that produces good interpolation results.

In 412, the candle controller can determine the content and the layout of the content that is to be output to the touch screen display in the candle portion. The content can include a number of active areas that when selected via touch screen sensor associated with the display can cause the candle controller to perform an action, such as change the content associated with the candle portion. The candle controller can determine a touch screen mapping that associates the active areas output to the display with locations of touch screen data that will cause the candle controller to respond. The touch screen mapping may change depending on the content currently displayed in the candle portion and the display mode selected for the candle portion.

In 414, the candle controller can generate the content for candle-controlled display interface. The candle controller can be configured to generate content with different resolutions depending on a size selected for the candle portion. In one embodiment, a maximum resolution for the candle content can be selected where the candle controller is configured to select a display resolution that is equal to or less than the maximum resolution. The maximum resolution content can be utilized for all the display resolutions selected by the candle controller. In the case where the display resolution is smaller than the resolution of the candle content, the candle content can be scaled down to fit the display resolution.

The candle controller can be configured to save to a memory portions of the candle content and/or parameters used to generate the content that are output at any particular time. In addition, information relating to the context in which the content was generated can be stored. For instance, a time at which particular candle content was output, a display mode to which the candle content was output and a state of the game when the candle content was generated can be output. In one embodiment, the saved candle content and/or parameters used to generate the content can be used for auditing or dispute resolution purposes.

In 416, the candle controller can send control commands to the touch screen display. The control commands can affect a size and position of where content from the game controller and content from the candle controller is to displayed to the touch screen display. In addition, the display parameters can affect a scaling of touch screen data received from the touch screen sensor. The scaling can affect how touch screen data is returned to the game controller. In one embodiment, the resolution of the content output by the game controller and sent to the display can be constant for any of the combination of display parameters selected by the candle controller. Thus, at a first time the candle controller can select a game portion of a first size and at a second time the candle controller can select a game portion of a second size for displaying the game content where at each time the resolution of the game content generated by the game controller is the same. In 416, the candle controller can also send content for a candle portion to the touch screen display.

In 418, the candle controller can receive touch screen responses associated with both game portion and the candle portion where game content and candle content are each respectively displayed in the game portion and the candle portion. In one embodiment, the candle controller can be configured to determine whether only touch screen input associated with active areas of the candle content have been received. When the candle controller determines that an active area associated with the candle content has been selected in 420 the candle controller can respond. One response is to change the content output in the candle portion. In another embodiment, the candle controller can determine that an active area associated with the game content has been selected and in response change the content output in the candle portion. The candle controller can be configured to save touch screen data associated with only candle portion or both the candle portion and the game portion, such as a location on the touch screen where a touch screen input has been detected and a time that the touch screen input was detected.

Methods for Transaction Verification Using a Candle Device

Next with respect to FIGS. 9, 10, 11A and 11B method and apparatus for verifying casino transactions are described. In a particular embodiment, verification of electronic transactions involving a transfer of funds to the gaming from a remote account is provided. The funds transfer can be initiated from a portable electronic device, such as a smart phone or a table computer. A candle device can be configured to generate a verification interface using a display of the gaming machine. The verification interface can allow a player to enter verification information that can be used to validate the transaction. Further, the verification interface can be used to indicate a status of the transaction, such as whether it is being authorized, has been approved or has been rejected.

Figure 9:
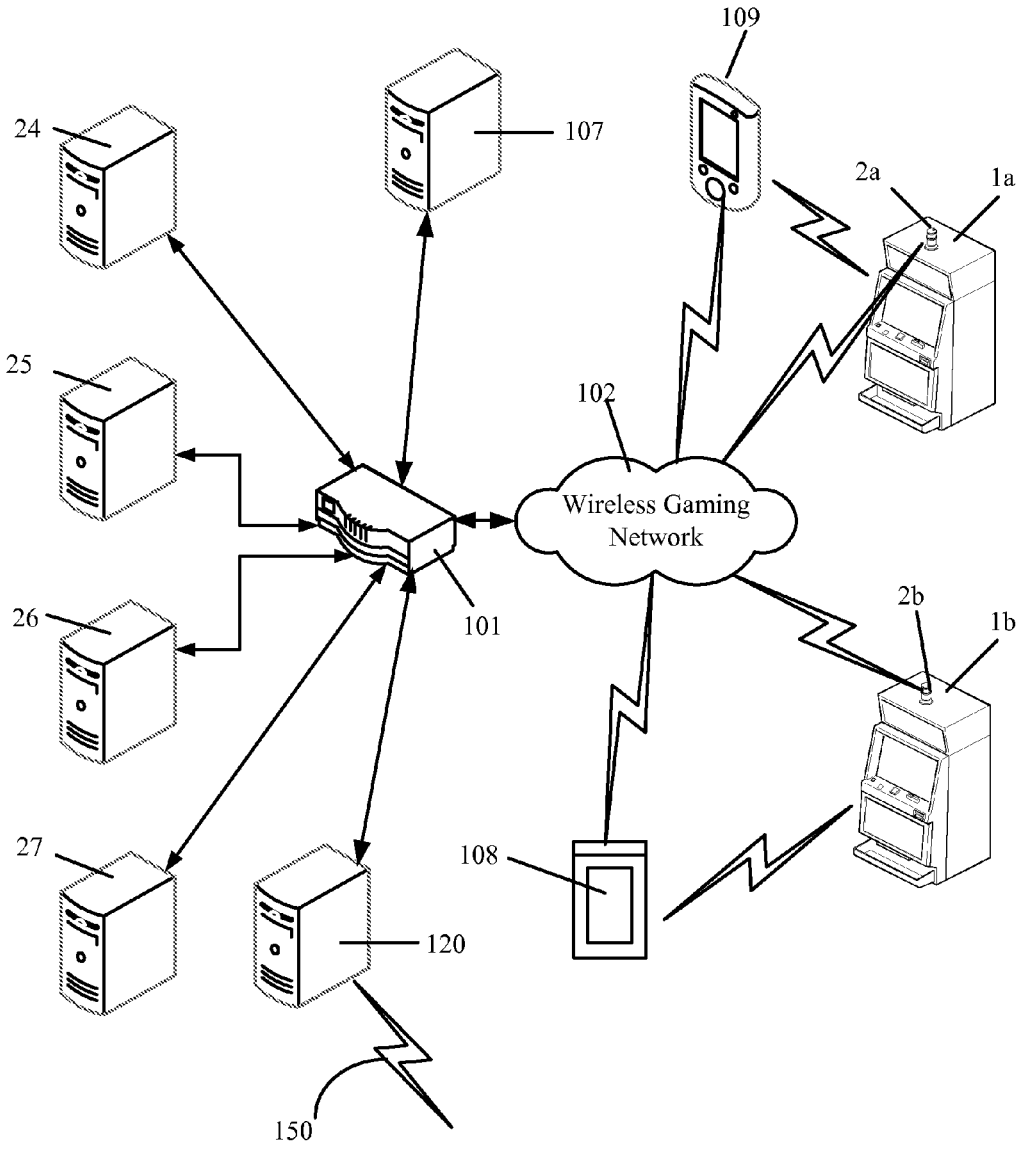
FIG. 9 is a diagram of a gaming system including gaming machines outfitted with candle devices and configured to communicate with mobile devices in accordance with the described embodiments.

FIG. 9 is a diagram that illustrates a gaming system including gaming machines outfitted with candle devices that wirelessly communicate with servers in accordance with the described embodiments. In one embodiment, the gaming system can include one or more gaming machines, such as 1*a* and 1*b*. The gaming machines can be different models and types supplied by different gaming machine manufacturers. The gaming machines can each be equipped with candle device, such as 2*a* and 2*b*. In one embodiment, the candle devices can be coupled to a dual port touch screen display on the gaming machines 1*a* and 1*b* in a manner described above with respect to FIGS. 7A, 7B and 8. The candle devices, 2*a* and 2*b*, can be configured to generate on the touch screen display devices an interface for verifying a transaction. Further details of the verification interface are described as follows with respect to FIGS. 10, 11A and 11B.

The candle devices 2*a* and 2*b* can be configured for wireless communications as described above with respect to FIGS. 1-4. Using the wireless capabilities of each candle device, a gaming network 102 can be provided. Via the gaming network 102, the wirelessly enabled candle devices, such as 2*a* and 2*b*, can communicate with a system controller 101. The system controller 101 can transmit and receive data from the gaming network 102. In one embodiment, the system controller 101 can be configured to de-multiplex/de-encrypt the data stream from the gaming machines equipped with wireless capabilities and send the resultant data streams to the respective gaming system servers to which particular wireless communications are addressed.

In particular embodiments, wireless access points can be provided that allow a portable electronic device, such as 109, to communicate with other gaming devices in the wireless gaming network. For instance, via a Bluetooth™ interface in the candles 2*a* or 2*b*, a portable electronic device can be allowed to communicate with a casino server, such as 120. As another example, Wi-Fi access points can be distributed throughout a gaming environment, such as a casino, which allow communications with a casino server, such as 120. In one embodiment, the server 120 can support a hospitality application executing on the portable electronic device. For instance, MGM resorts International™ provides an "M life" players club application that can be executed on a player's portable electronic device, such as 109.

In another example, the gaming machines, such as 1*a* and 1*b*, can include other devices capable of communicating with a portable electronic device. For example, a gaming machine can include a secondary device, such as a bill validator, which is configured to receive account information that enables electronic cash transaction from a portable electronic device. In one embodiment, the portable electronic device can include an NFC (Near field Communication) interface that can communicate account information via a NFC interface on the gaming machine, such as an NFC interface on a bill validator. As an example, the portable electronic device can execute an electronic wallet application that supports electronic purchases via an NFC interaction like PayPass™ by MasterCard™. The electronic wallet application can be used to initiate a transfer of funds that allows credits to be deposited onto the gaming machines.

After a device, such as the bill validator receives information via the NFC interaction, the bill validator can be configured to send the information to the candle device. The information can include an account identifier from which the funds are to be transferred. In response, the candle device can be configured to generate a verification interface (see FIGS. 11A and 11B) that allows transaction validation information associated with the account to be entered. Further, the candle device can be configured capture an image of the person that is requesting the transaction.

Typically, it is not possible to provide an interface for entering verification data via the bill validator because the bill validator is only afforded a small area on the outer surface of the gaming machine. Typically, a small slot, a surrounding bezel and a landing area for placing bills or tickets are all that is provided. However, a candle device upon receiving an indication of a transaction from a secondary device, such as bill validator, can be configured to generate a display interface on a touch screen display associated with the gaming machine. The candle controller can output content to the display interface and respond to touch inputs received via the display interface in a manner that allows verification information associated with the transaction to be received and a status of the transaction to be displayed to a player. As described above, the candle can generate the display interface without the participation of the game controller.

Next, after receiving information via the verification interface, the candle 2 can send the account identification received from the bill validator and the verification information received via the verification interface to a casino server, such as 120. The casino server can include account information that allows the server to determine if the verification information received from the candle device matches the verification information associated with the account. If necessary, the casino server 120 can be configured to contact other remote devices via outside interface 150 and request account verification where the request includes verification information entered via the display interface generated by the candle. In response, the remote devices can determine whether the verification information is valid or not and communicate the validity of the transaction to the casino server 120. Then, the casino server 120 can notify the bill validator, via the candle whether the transaction is valid or not.

In one embodiment, the casino server 120 can include an alternate communication mode associated with the account, such as an e-mail address. The candle, such as 2*a* or 2*b*, can be configured to send biometric information about the person requesting the transaction, such as a captured image of the person to the server 102. In response to receiving the biometric information, the server 120 can be configured to send a message including the biometric information (e.g., the captured image of the person requesting the transaction via) the alternate communication mode. For instance, the message might indicate that a transaction associated with the account has been performed by the person in the captured image. If an authorized person is performing the transaction, then the message receiver can respond back to the server 120. In response to receiving the indication that the transaction is not valid, the server 120 may freeze the account and send the captured image to security. Then, if the person in the image attempts another transaction, security can be notified and the person can be identified by the captured image data from the previous transaction. Further details of the verification interface and a method of using the verification interface are described with respect to FIGS. 10, 11A and 11B. However, first, additional details of the gaming network 102 including other servers and their functions that can communicate with gaming machines via the network are described.

Other examples of servers that can receive data streams from the system controller 101 include but are not limited to the player tracking server 24, the WAP (Wide Area Progressive) server 25, link progressive server 26 and the TITO (Ticket-in/Ticket-out) server 27. These servers can communicate with one or more of the gaming machines by routing communications through the system controller 101.

A few other examples of servers that can be coupled to the wireless gaming network 102 via the system controller 101 can include servers in other gaming establishments, servers associated with gaming regulators, third-party servers, servers providing game downloads and peripheral software updates, security server, servers providing hotel hospitality, travel, weather and lodging information and outside access to servers via the Internet. As an example of a server in another gaming establishment, the system controller 101 can be configured to contact a remote TITO server in another gaming establishment to validate a printed ticket remotely issued outside of the gaming establishment in which the system controller is located and forward the validation information to a gaming machine. As an example of a communication with a gaming regulator, the system controller 101 can be configured to communicate with a gaming regulator to notify the regulator of a regulated change to a gaming machine, such as a change in regulated gaming software on the gaming machine.

Gaming operators can allow third-parties affiliated with a gaming establishment to provide promotional opportunities to players on gaming machines. The system controller 101 can be configured to communicate with a gaming machine to provide a third party promotional opportunity. As an example, via the system controller 101 and the wireless gaming network 102, a ticket can be printed at the gaming machine that allows a discount on a merchandise item or a service provided by the third party. In some embodiments, the tickets can be customized using a format selected by the third party and approved by the gaming operator.

The system controller 101 can be configured to allow a remote server to communicate regulated or unregulated gaming software to a gaming device. Regulated gaming software typically includes logic related to generating a wager-based game on the gaming machine, such as determining an outcome and an associated award. An example of unregulated gaming software may include firmware used by a peripheral device, such as firmware used by a bill validator or printer to report information used for health monitoring, firmware used by a bill validator to detect fraudulent currency or firmware used by a printer to print customized tickets. If the bill validator accepts a bill or an instrument that is later determined to be counterfeit, then new software can be downloaded to the bill validator to detect other bills or instruments with similar characteristics so that additional counterfeit bills or instruments are not accepted. The system controller 101 can also be configured to transmit and receive verification information that allows a remote server to verify that authentic software has been installed on a gaming device, such as gaming machine.

Each gaming machine can be connected to a different combination of gaming system servers, such as but not limited to a player tracking server 24, WAP server 25, link progressive server 26, and the TITO Server 27. For instance, a first gaming machine can be connected to only the casino back-room server 107 while a second gaming machine can be connected to the player tracking sever 24 and the TITO server 27. The system controller 101 can be configured to allow different gaming machines to receive different data streams depending on a current server connection configuration. A current connection configuration for a particular gaming machine, such as adding a new connection to a server or removing a current connection to a server can be implemented via operator communications with the system controller 101.

The system controller 101 can be configured to provide the multiplexing of the data streams from the gaming system servers and then encrypt the resultant data stream before transmitting. The data streams can be encrypted to prevent tampering and misuse of any data sent in the data streams. The wireless gaming network 102 may use one or more common wireless technologies such as Zigbee, 802.11 a/b/g/n, and 3G/4G. Also, optical transmission technologies, such as IR and laser, can be utilized alone or in combination with other transmission technologies. In other embodiments, power-line transmission technologies or other wired communication technologies can also be utilized alone or in combination with one or more different wireless technologies as part of a gaming network.

Existing gaming systems typically use some form of a protocol stack. There are standard gaming protocols, such as S2S, G2S developed by the Gaming Standards Association (GSA) and SAS developed by IGT as well as many other proprietary protocols used in the gaming industry. The protocols are used by gaming systems, such as a player tracking system or a TITO system, to communicate data between the gaming machine and servers across a network. The gaming systems may also use encryption to protect data in transit. All of the gaming system's protocols and encryption techniques must be tested and approved by a gaming test lab and/or gaming control board to operate in their jurisdictions. In order to maintain integrity and security it is important not to tamper with or change the data streams of these gaming systems. The gaming system including the system controller 101, the wireless network 102 and candle devices 2*a* and 2*b*, can be configured to provide a non-intrusive technique to transmit and receive the data provided by these various systems, i.e., without a modification to an existing protocol that would require additional testing and approval.

In yet another embodiment, a back room server 107 and a gaming table 108 can be added to the system. The back room server 107 can be used to provide some of the real time changes to the entertainment, informational and promotional opportunities available on a gaming machine, such as 1, or on a gaming table, such as 108. For instance, promotional tickets can be printed at gaming tables and gaming machines in a dynamic manner using the back room server 107. As another example, tournaments or other group games can be provided using the back room server 107.

Figure 10:
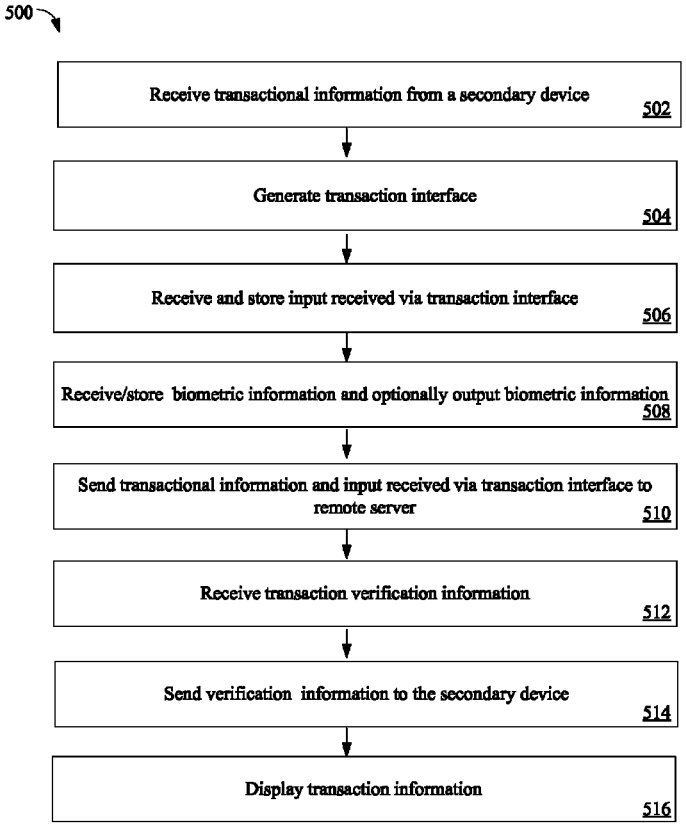
FIG. 10 is a flow chart of a method for verifying transactions in accordance with the preferred embodiments.

Next, further details of transaction verification using a display interface generated by a candle device are described. FIG. 10 is a flow chart of a method 500 for verifying transactions using a secondary processor in a candle device. In 502, the secondary processor can receive transactional information from a peripheral device. The transactional information can be included in a request to verify a transaction associated with the transactional information. The transactional information can be sent via a communication pathway that by-passes the game controller. Thus, this verification process can be transparent to the game controller.

For instance, a bill validator on a gaming machine can receive transactional information from a smart phone. The transactional information can include an account identifier and a request to withdraw a particular amount of funds from the account associated with the account identifier and convert the funds to credits on the gaming machine. In one embodiment, the bill validator can request the candle device to provide an interface for entering verification information associated with the transaction. The bill validator can be a dual port bill validator that communicates with the game controller through a first port and the candle device through a second port where each port is coupled to a separate communication channel. The communications through the second port between the bill validator and the candle device can by-pass the game controller.

In 504, the candle controller can generate a transaction interface on the main touch screen display of the gaming machine. While the transaction interface is being generated, the game controller is also outputting game content to the display as well. The generation of the transaction interface can include determining a size and a position of a window for outputting the game content and a size and a position of a window for outputting the content associated with the transaction interface. After the determination, control commands can be sent to the display from the candle device relating to the windows. Prior to the control commands, the game content can be displayed in a first window of a first size on the display, such as the entire display, after the control commands, the game content be displayed in a second window of a second size on the display that is smaller than full size.

The video content for the transaction interface can include a number of buttons that indicate locations where a touch can be made to enter information. For instance, key board buttons can be displayed to enter letters and buttons with numbers can be displayed to enter letters. One or more numbers, letters (upper and/or lower case), symbols (e.g., exclamation point or question mark) and combinations thereof can be entered when touches are detected at locations on the touch screen corresponding to the locations of the buttons output to the display. The information that is entered can be used to validate a transaction. For instance, a PIN can be entered and then compared to a PIN associated with an account before a transfer of funds from the account is authorized.

In 506, the candle device can receive touch inputs from the touch sensor and determine whether the touch inputs correspond to particular input buttons that are displayed. When the touch input is determined to be associated with an input button than the candle device can be configured to change the video content output to the display associated with the interface and/or output a sound to an audio device. For instance, when selected, a color of a touch button may change and/or clicking noise can be output from the audio device, such as a speaker coupled to the candle device. An example of an interface for entering data is described in more detail with respect to FIGS. 11A and 11B.

In 508, the candle device can be configured to gather biometric information of the person requesting the transaction. In one embodiment, an image capture device on the candle device can capture an image of the person requesting the transaction. In one embodiment, the biometric information that has been gathered can be output. For instance, an image of the person requesting the transaction captured via the camera on the candle device can be output to the main display.

In 510, the candle device can send to the remote server the transactional information, such as an amount of funds and the account from which to withdraw the funds. The transaction information can be received from a secondary device, such as a bill validator. The bill validator may have received the transaction via an NFC enabled communication between the bill validator and a portable electronic device. In addition, the candle device can send the input entered via the transactional interface, such as a PIN or a password including numbers, letters, symbols or combinations thereof and optionally biometric information to the remote server. In the message including the data, the candle device can request the remote device to validate the transaction based upon the information that the candle sends to the remote device.

In one embodiment, the remote device can store account information for a casino account. A player may have previously established and deposited funds into the casino account. The player can carry an account identifier for the account on their portable electronic device which can be read wirelessly from a secondary device, such as the bill validator. Via an interface on their portable electronic device or the verification amount generated by the candle, the player can request an amount of funds to transfer from the account to the gaming machine. An advantage of transferring funds in this manner is that the gaming machine doesn't have to accept and store a ticket voucher, which can potentially lower operation costs.

The casino account can include secondary contact information for the player, such as an email. When transaction verification is requested, the remote server can be configured to send a message using the secondary contact information indicating a transaction has been requested. In one embodiment, the message can include biometric information, such as an image of the person requesting the transaction. The image of the person can be capture using an image capture device located on the candle device. Alternatively, the remote server can send the secondary contact information to the candle device which can generate and send the message indicating a transaction has been requested via the secondary contact information. For instance, an e-mail message, text message or voice message can be sent to the user associated with the account. The text message or voice message can be sent to a phone number that is different from a number of a portable electronic device used to initiate the transaction.

In another embodiment, the account information received from the player's portable device can be for an external account, such as a debit card. The funds can be associated with the debit card, i.e., a particular amount associated with the card or the funds can be linked to an account, such as bank account. The verification information that is received via the verification interface, such as a PIN, can be sent to a casino server. The casino server can then contact a remote device such as a remote device associated with a financial institution for verification and approval of the transaction. In another embodiment, the candle device can be configured to directly contact the remote device for verification. An advantage of routing all of the verification and transaction approvals through a single casino server is that the access points to the internal casino network are limited because all of the transaction requests are routed through a single casino server.

In one embodiment, a player can register secondary contact information in a loyalty program account with the casino. For a transaction, such as the debit card transaction in the preceding paragraph, when a user can be identified with the transaction, the candle device can be configured to determine whether the user associated with the transaction is registered in the loyalty program and whether the loyalty program account stores secondary contact information for the user. When the candle determines secondary contact information is available, it can generate a message indicating an attempted transaction has been made via the communication mode associated with the secondary contact information. As described above, the message can include biometric information, such as an image of the person attempting the transaction, as well as transaction information received, such when, where and what type of transaction was attempted.

In 512, the candle device can receive touch sensor data from the main display and determine what information has been entered, such as a PIN or a transaction amount. In response to receiving the verification information, the candle device can also attempt to gather biometric information. For instance, an image capture device on the candle can be used to take a picture of the person initiating the transaction. In 514, the verification information can be sent to a remote device where the remote device determines whether the transaction is to be authorized based upon the verification information. In another embodiment, the candle device can request verification information from the remote device based upon the account information received from a secondary device, such as a bill validator. Using the verification information received from the remote device and the verification information received from the interface, the candle can compare the information and determine whether the transaction is valid.

In 516, the candle device can display to the verification interface a transaction status, such as transaction verification in progress. When the verification of transaction is complete, the candle device can display whether the transaction has been authorized or not. Next, the candle can close or display alternate content in the verification interface. When the verification interface is closed, the candle device can resize the window that is used to display the game content. For instance, the window can be enlarged to fill the entire display as opposed to a portion of the display.

Display Interfaces

Figure 11A:
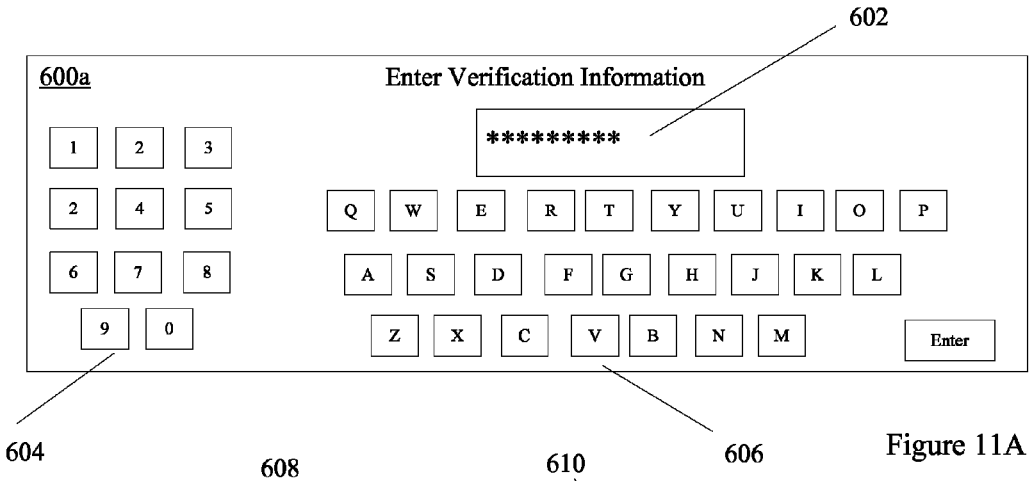
FIGS. 11A-11C are diagrams of display interfaces generated using a candle device in accordance with the preferred embodiments.
Figure 11B:
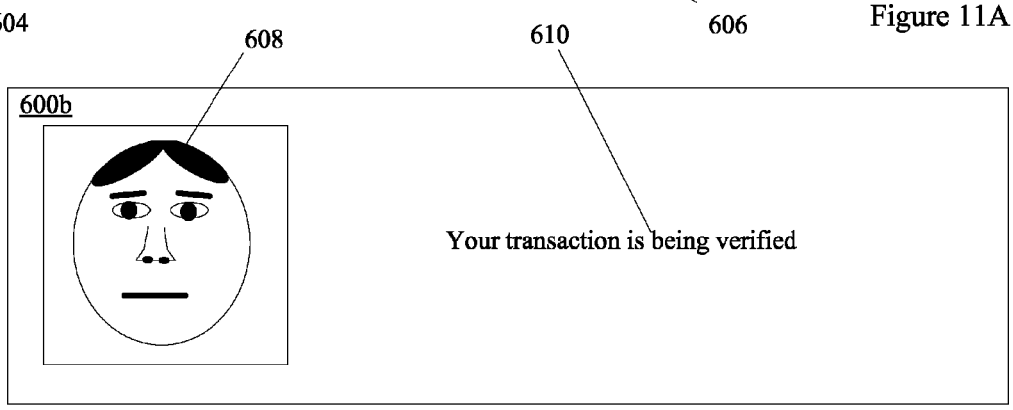

FIGS. 11A-12D are diagrams of display interfaces generated using a candle device in accordance with the preferred embodiments. In FIG. 11A, a portion of the display screen 600*a* is allocated for entering verification information. As an example, a key pad 604 that allows the entry of numbers, such as digits is associated with a PIN is provided. In addition, a key board is displayed. The keyboard allows the entry of alphabet symbols, such as but not limited to symbols associated with a Roman alphabet. In other embodiments, other alphabets or characters associated with a language, such as Chinese can be displayed.

The keyboard and number pad can be displayed on a video display with a touch screen. As touch screen data is received, the candle device can determine what buttons have been selected and which number, letter, symbol, etc. that corresponds to the button. The selection can be entered in the box 602 on the display. The selected data can be temporarily visible and then covered with an asterisk for security. After selecting the enter button, in 600*a*, the candle device can generate the content associated with 600*b*. In 600*b*, a status of the transaction 610 is displayed. In one embodiment, an image 608 of the person requesting the transaction can be displayed. As described above, an image capture device on the candle device can be used to capture the image data.

In one embodiment, the touch screen sensor and display can be configured to read biometric information, such as finger print information. In 600*a*, a message can be displayed, such as place finger (or fingers) here. A box or some other shape can be drawn around the location so that the user knows where to place their finger. The biometric information can be read from the player via the touch screen and this information can be used to verify the transaction.

Figure 11C:
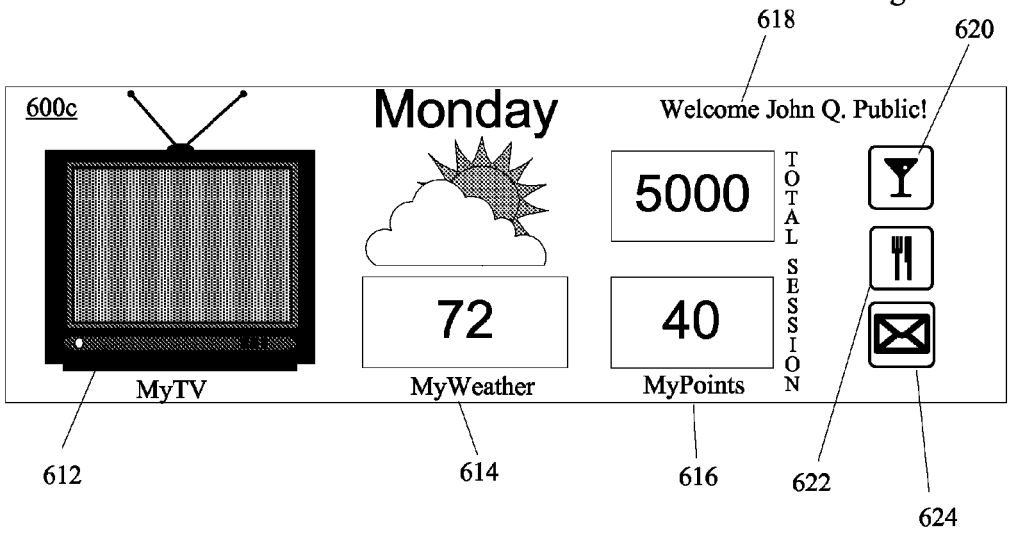

FIG. 11C is an example of video content 600*c* associated with a player interface that can be output to a display, such as a portion of the main display on a video gaming machine. In one embodiment, the video content associated with the interface can include a player name 618, a drink symbol 620, a food dining symbol 622, a message symbol 624, information 616 associated with a loyalty program account, personalized information 614, such as weather in a location of interest to a user and information 612 regarding programs that the player can watch. When the drink symbol is selected 620, an interface for ordering the drink can be generated. The interface can include a number of drink options that are available. When the food dining symbol 622 is selected, an interface for learning about nearby restaurants, making a reservation or ordering food that can be brought to a gaming machine can be displayed. When the message symbol 624 is selected, an interface that allows a user to send a message to another person can be generated. For instance, interface can be configured to allow a person to send a message to a friend or request the presence of an attendant.

The MyPoints information 616 can display information about points earned in a loyalty program. The information can include total points and points earned in a particular session. The MyWeather section 614 is an example of personalized information that can be provided to a player. The MyTV section 612 can display an interface for selecting a program to watch. For example, the interface may allow a user to select a live sporting event, a show (e.g., a sitcom) or a movie to watch.

Figure 12A:
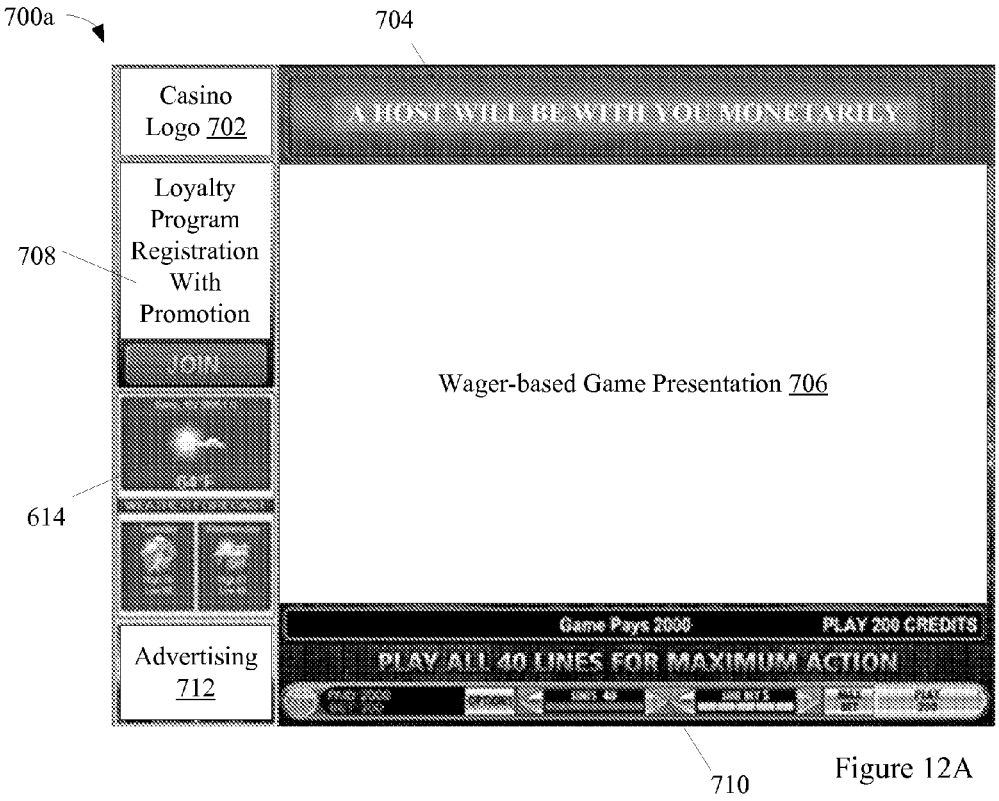
FIGS. 12A, 12B, 12C and 12D are diagrams of display interfaces generated using a candle device in accordance with the preferred embodiments.

FIG. 12A shows one embodiment of a full screen layout 700*a* for content that can be output to a main display of a gaming machine under control of a candle device. In the layout, a top horizontal strip and a left vertical strip are provided for video content output via a candle device. The game content including a wager-based game presentation and a status of the game are provided in the remaining portion of the screen layout 700*a*. As described above, a game controller on a gaming machine can generate the game content.

The content generated by a candle controller can include but is not limited to a casino logo 702, a status message 704, such as a message indicating a host has been called, advertising 712, personalized information, such as the weather 614, and a button for initiating a registration interface that allows an individual to register in a loyalty program at the gaming machine. When the candle controller detects the join button has been selected, the candle controller can output content associated with a registration interface to the display or a host can be called to carry out the registration process.

Figure 12B:
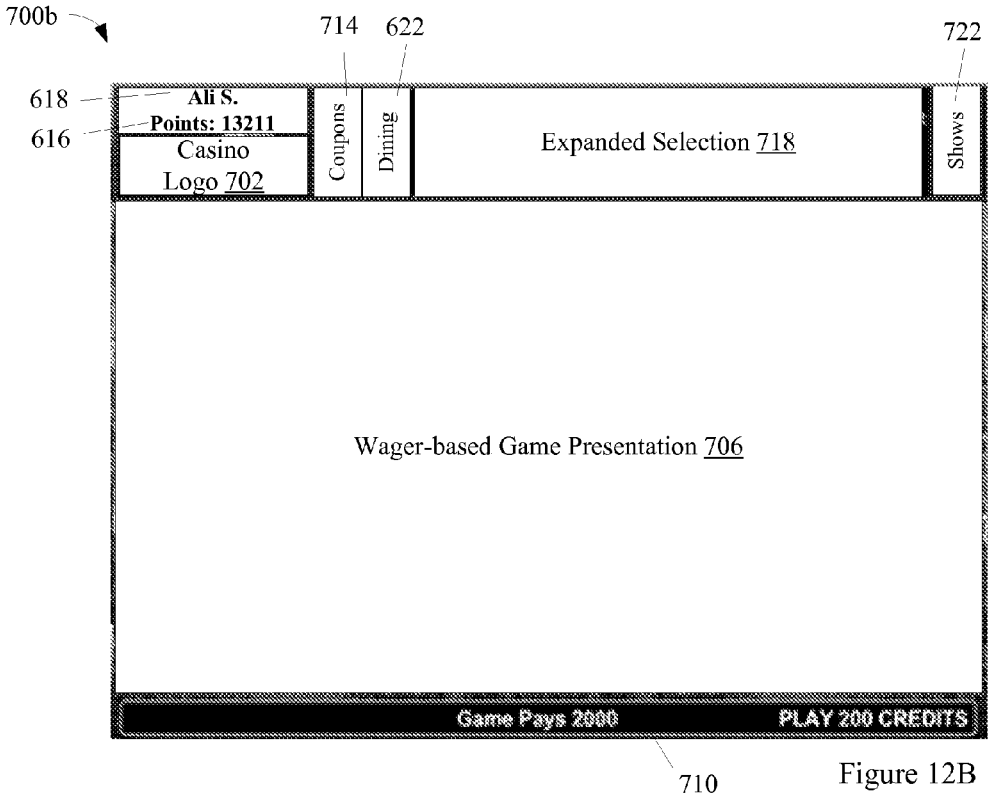

FIG. 12B shows another embodiment of a display layout 700*b*. In layout 700*b*, content output by the candle controller is output on a top horizontal strip of the display. A remaining portion of the display is allocated to a wager-based game presentation and a status interface 710. A number of expandable buttons can be provided in the candle portion. For example, when the coupons 714 button, the dining button 622 or the shows button 722 is selected additional information about the selected item can be displayed. In FIG. 12B, the dining button 622 has been selected and additional information about dining options, such as a list of restaurants is displayed in the expanded selection section 718.

Figure 12C:
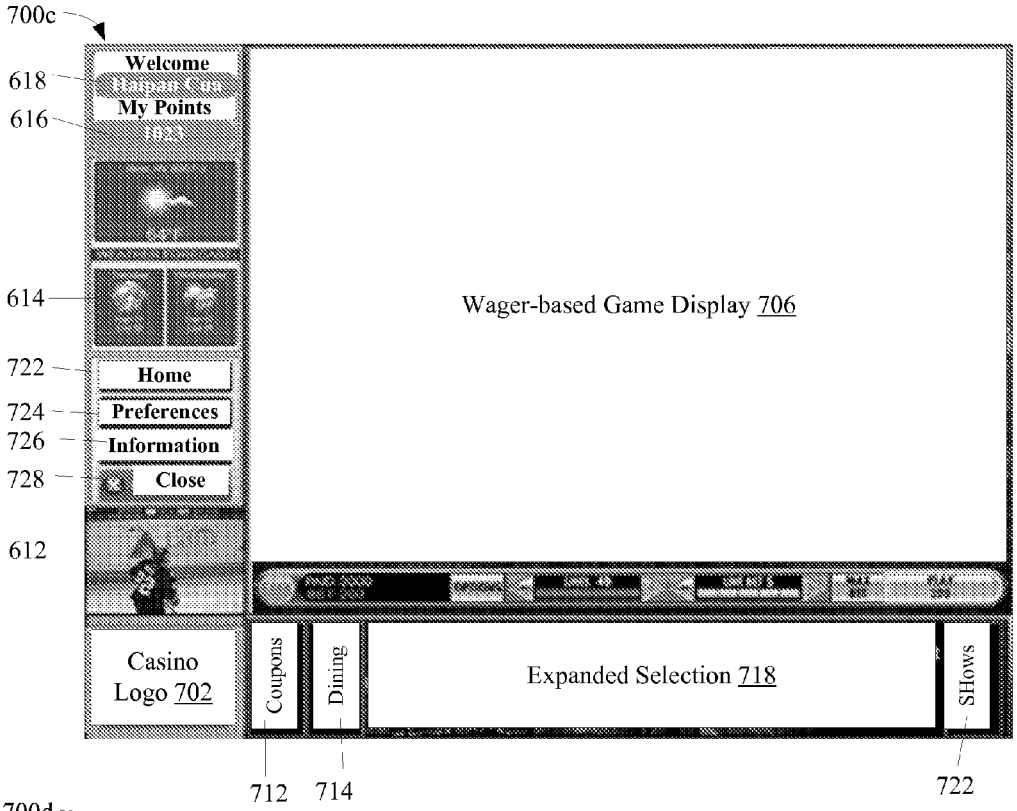

FIG. 12C shows yet another embodiment of main display layout 700*c*. In this example, the candle generated content is output to a left vertical strip and a bottom horizontal strip of the display. As described above, the candle controller can be configured to allocate different amounts of the main display for the game content and candle content at different times. In 700*c*, player name 618 and player points 616 are displayed in the top left corner. The personal information of interest to the player, such as the weather 614 is displayed beneath the player points.

Next, a number of buttons, home 722, preferences 724, information 726 and close 728 are displayed. A selection of the home button 722 can cause the candle controller to return the display to a default layout, such as a top menu in a menu tree. A selection of the preferences button 724 can cause an interface to be displayed that allows a user to select a preferred format for the content output by the candle controller. For instance, the user can choose to display or not display the weather information 614 or select a city for which to display the weather. The information button can cause the candle controller to display a number of menu buttons that allow the user to learn different information, such as the shows and dining buttons shown in FIG. 12B. Below these buttons, a live sporting event 612 selected by the user is displayed.

Figure 12D:
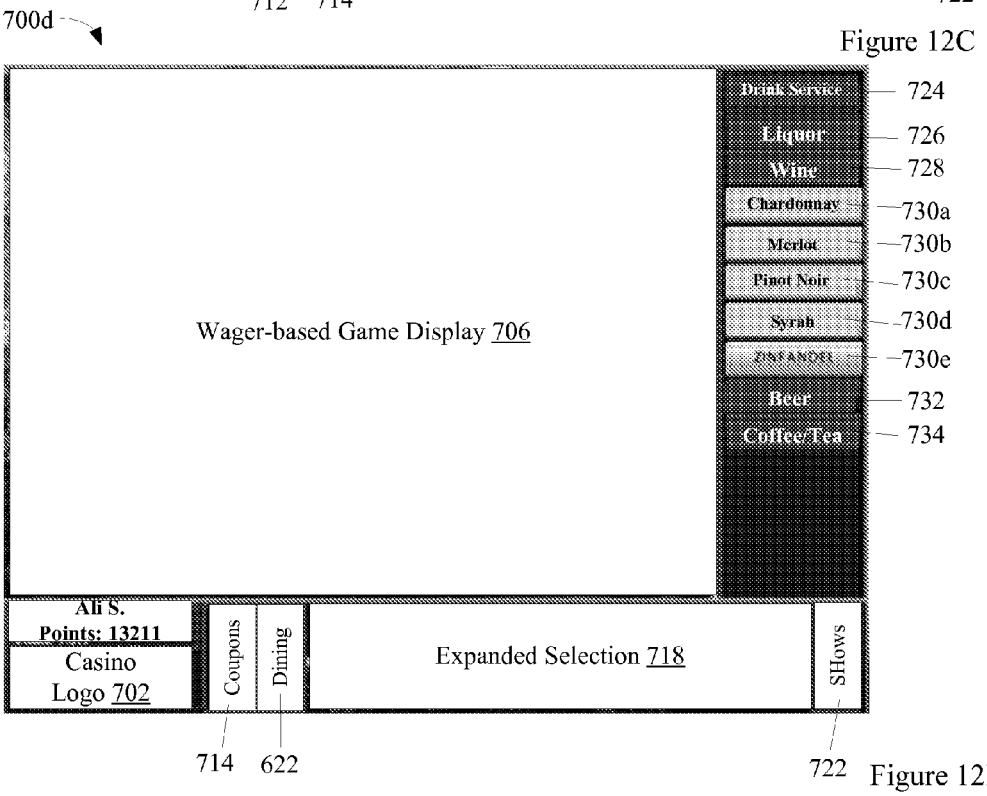

FIG. 12D shows an embodiment of a main display layout 700*d*. In layout 700*d*, candle control content is output to a bottom horizontal strip and a right vertical strip of the display. In this example, a drink service button has been selected in response, a number of drink choices buttons, liquor 726, wine 728, beer 732 and coffee/tea 734 are displayed. Initially, the buttons can be displayed without an expanded selection. After one of the buttons is selected, the selections under each button can be expanded. For instance, after the wine button 728 is displayed, the chardonnay 730*a*, Merlot 730*b*, Pinot Noir 730*c*, Syrah 730*d* and Zinfandel 730*e* selections are displayed. Selecting one of these buttons may result in additional selectable buttons being displayed in the selected category. For instance, a selection of the Merlot button 730*b* can result in a list of merlot selections that are available being displayed in 700*d*.

The hardware, methods and interfaces described above are not limited for use on wager-based gaming machines. In alternative embodiments, hardware, methods and/or interfaces can be implemented in a kiosk, a vending machine or an Automatic Teller Machine. For instance, the verification interfaces described with respect to FIGS. 11A and 11B can be used in a kiosk or a voucher redemption device to verify a transaction.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, DVDs, flash memory, memory sticks, magnetic tape, and optical data storage devices. The computer readable medium can also be distributed over network-coupled computer systems so that the computer readable code is stored and executed in a distributed fashion.

The many features and advantages of the present invention are apparent from the written description and, thus, it is intended by the appended claims to cover all such features and advantages of the invention. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A method in a gaming device including a secondary controller having a processor and a memory comprising:

determining in the secondary controller a native resolution of first video content for a wager-based game generated by a game controller on a gaming machine wherein the first video content is output to a dual port touch screen (DPTS) display including a first video port to receive the first video content for the wager-based game and a second video port to receive second video content from the secondary controller;

determining in the secondary controller a display interface controlled by the gaming device is triggered;

based upon the determined native resolution of the first video content for the wager-based game and a resolution of the of the DPTS display, determining a display mode for the DPTS display wherein the display mode includes a first resolution and a first position of a first display window on a first portion of the DPTS display in which the first video content for the wager-based game is output and a second resolution and a second position of a second display window on a second portion of the DPTS display associated with display interface in which the second video content from the secondary controller is output;

sending, from the secondary controller, commands to the DPTS display to generate the display mode including commands to generate the first display window on the first portion of the DPTS display with the first resolution greater than the native resolution of the first video content for the wager-based game;

sending from the secondary controller the second video content to the second port of the DPTS display;

receiving, in the secondary controller, touch screen data from the DPTS display wherein the DPTS display is configured to send the touch screen data from an entire DPTS display to the secondary controller via first communication pathway and only the touch screen data associated with the first resolution and the first position of the first display window via second communication pathway directly to the game controller; and in response to receiving the touch screen data, sending, from the secondary controller, new video content to the second port of the DPTS display.

2. The method of claim 1, wherein a resolution of the dual port touch screen display is greater than the native resolution of the first video content of the wager-based game.

3. The method of claim 1, wherein the first resolution of the first display window is always greater than or equal to the native resolution of the wager-based game.

4. The method of claim 1, wherein a resolution of the second video content sent from the secondary controller is a fixed value further comprising selecting the second resolution of the second display window that is equal to or less than the fixed value.

5. The method of claim 1, further comprising: while the display interface is displayed, receiving from the game controller a command to change a lighting configuration of one or more of the plurality of lighting stages on a candle device.

6. The method of claim 1, wherein the touch screen data from the DPTS display is received via a communication pathway separate from the first port or the second port.

7. The method of claim 1, further comprising: based upon the touch screen data, determining a touch screen input button displayed in the second display window has been activated.

8. The method of claim 1, further comprising:

based upon the first resolution and the first position of the first display window associated with the wager-based game, determining a location of a touch screen input button in the first display window associated with the wager-based game, based upon the touch screen data from the entire DPTS display, determining the touch screen input button in first display window has been activated and in response sending new video content associated with the display interface to the DPTS display.

9. The method of claim 1, wherein the secondary controller is configured to generate the video content according to a tree hierarchy wherein a selection of various touch screen input buttons associated with the tree hierarchy allows a user to navigate within the tree hierarchy.

10. The method of claim 1, further comprising generating video content for a transaction verification interface for electronically transferring funds to the gaming machine.

11. The method of claim 10, further comprising: in response to receiving touch screen input data associated with the transaction verification interface, sending a request to authorize a transaction to a remote device wherein the touch screen input data associated with the transaction interface is not received by the game controller.

12. The method of claim 1, further comprising: generating video content for the display interface that allows a user to order a drink.

13. The method of claim 1, further comprising: generating video content for the display interface that allows a user to select video programming to watch via the display interface.

14. The method of claim 13, wherein the video programming is a video feed for a live sporting event.

15. The method of claim 1, further comprising: receiving from a remote device a video feed for video programming and integrating the video feed into the display interface.

16. The method of claim 1, further comprising, selecting at a first time a first display mode wherein the second display window for outputting the second video content is not visible and the first display window for outputting the first video content from the wager-based game and selecting at a second time a second display mode wherein the second display window for outputting the second video content is visible and the first resolution of the first display window for outputting the first video content from the wager-based game is smaller than in the first display mode.

17. The method of claim 1, further comprising, determining a current state of the gaming machine and based-upon the current state of the gaming machine, determining to delay changing the display mode until the current state is completed.

18. A retrofit system for a wager-based gaming machine including a gaming machine cabinet comprising:

a touch screen display for replacing an existing main display on the gaming machine and a gaming device for replacing an existing candle device on the gaming machine;

the touch screen display comprising:

a) a touch screen sensor;

b) a first video port configured to receive first video content for a wager-based game from a game controller wherein a resolution of the touch screen display is greater than a native resolution of the first video content received from the game controller and the existing main display which is replaced;

c) a second video port configured to receive second video content associated with a display interface from a secondary controller;

d) a touch screen display controller for i) receiving control commands from the secondary controller wherein the control commands specify a display mode including a first resolution and a first position of a first display window on a first portion of the touch screen display for displaying the first video content from the game controller and a second resolution and a second position of a second display window on a second portion of the touch screen display for displaying the second video content from the secondary controller associated with the display interface; ii) scaling touch screen input data in response to the control commands iii) sending touch screen input data associated with the first portion directly to the game controller via a first touch data interface and iv) sending touch screen input data associated with the first portion and the second portion to the secondary controller via a second touch data interface;

e) a display configured to display the first video content on the first portion and the secondary video content on the second portion in accordance with the display mode; and the gaming device comprising:

a mounting interface coupled to a housing for mounting the gaming device to an exterior or an interior surface of the gaming machine cabinet;

a secondary controller, including a processor and a memory, secured within the housing, configured to i) send the second video content associated with the display interface to the second port of the touch screen display and ii) send and generate the control commands for specifying the display mode to the touch screen display controller including the first resolution of the first display window greater than the native resolution of the first video content; iii) determine the second video content associated with the display interface which is output to the second display window, and a first communication interface coupled to a first communication pathway between the secondary controller and the game controller, a second communication interface coupled to a second communication pathway between the secondary controller and the second video port and a third communication pathway between the secondary controller and the touch screen display controller.

19. The retrofit system of claim 18, where the secondary controller is configured to select at a particular time one of a plurality display modes.

20. The retrofit system of claim 18, wherein the touch screen display controller is configured to send touch screen input data for an entire touch screen display to the secondary controller via the second touch data interface and only the touch screen input data associated with the first resolution and the first position of the first portion of the touch screen display directly to the game controller via the first touch data interface.

21. A gaming machine comprising:

a gaming machine cabinet;

a game controller, disposed within an interior portion of the gaming machine cabinet, the game controller configured to control a wagered based game including generating video game content for a wager-based game at a native resolution wherein the game controller is configured to send the video game content to a touch screen display via a first video port of the touch screen display and receive touch screen input data via a first touch data interface of the touch screen display;

the touch screen display including a) a touch screen sensor;

b) a first video port configured to receive the video game content from the game controller;

c) a second video port configured to receive secondary video content from a secondary controller;

d) a touch screen display controller configured to 1) receive control commands from the secondary controller wherein the control commands specify a display mode including a first resolution and a first position of a first portion of the touch screen display configured to display wherein a resolution of the touch screen display is greater than the native resolution of the video game content and wherein the first resolution is greater than the native resolution of the video game content the video game content from the game controller and a second resolution and a second position of a second portion of the touch screen display configured to display the secondary video content; 2) send the touch screen input data only associated with the first portion directly to the game controller via the first touch data interface and 3) send touch screen input data associated with the first portion and the second portion, via a second touch data interface, to the secondary controller;

d) a display configured to display the video game content on the first portion and the secondary video content on the second portion in accordance with the display mode;

a gaming device comprising:

a secure housing including one or more anti-tampering mechanisms;

a mounting interface attached to the housing for coupling the gaming device to an exterior surface or an interior surface of the gaming machine cabinet;

the secondary controller, including a processor and a memory, disposed within the housing, configured to i) send the video content to the touch screen display, ii) send and generate the control commands for specifying the display mode and iii) receive the touch screen input data associated with the first portion and the second portion output via the second touch data interface.

* * * * *